US010850498B2

(12) United States Patent
Mantani et al.

(10) Patent No.: US 10,850,498 B2
(45) Date of Patent: Dec. 1, 2020

(54) SCREEN PRINTING APPARATUS AND SCREEN PRINTING METHOD

(71) Applicant: Panasonic Intellectual Property Management Co., Ltd., Osaka (JP)

(72) Inventors: Masayuki Mantani, Saga (JP); Yoshinori Isobata, Fukuoka (JP); Takaaki Sakaue, Yamanashi (JP); Yuusuke Morita, Fukuoka (JP); Shuichi Tomeoku, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 194 days.

(21) Appl. No.: 16/159,959

(22) Filed: Oct. 15, 2018

(65) Prior Publication Data

US 2019/0118525 A1 Apr. 25, 2019

(30) Foreign Application Priority Data

Oct. 19, 2017 (JP) ..... 2017-202288

(51) Int. Cl.
*B41F 15/26* (2006.01)
*B41F 15/36* (2006.01)
(Continued)

(52) U.S. Cl.
CPC ..... *B41F 15/0822* (2013.01); *B41F 15/0881* (2013.01); *B41F 15/20* (2013.01);
(Continued)

(58) Field of Classification Search
CPC .. B41F 15/08; B41F 15/0818; B41F 15/0822; B41F 15/0881; B41F 15/0845; B41F 15/085; B41F 15/16; B41F 15/18; B41F 15/20; B41F 15/26; B41F 15/36; B41F 15/44; B41M 1/12; H05K 3/1216; H05K 3/1225; H05K 3/1233
(Continued)

(56) References Cited

U.S. PATENT DOCUMENTS

2011/0297020 A1* 12/2011 Tanaka ..... H05K 3/1216 101/126

FOREIGN PATENT DOCUMENTS

DE 102012019573 A1 * 3/2014 ..... B41F 15/0818
JP 05092544 A * 4/1993
(Continued)

*Primary Examiner* — Leslie J Evanisko
(74) *Attorney, Agent, or Firm* — Pearne & Gordon LLP

(57) ABSTRACT

There is provided a screen printing apparatus including: a mask plate on which a plurality of pattern holes are formed; a carrier supporter which supports a carrier which has a plurality of first openings and in which a plurality of workpieces are disposed on the plurality of first openings; a backup unit which has a plurality of workpiece supporters; a raising and lowering unit which lifts up the plurality of workpieces from the carrier and returns the plurality of lifted-up workpieces to the carrier; an aligner which aligns the plurality of workpieces in accordance with arrangement of the plurality of pattern holes; an overlapper which relatively moves the backup unit and the mask plate; and a print head which prints a paste on the plurality of workpieces on the plurality of workpiece supporters through the plurality of pattern holes.

18 Claims, 22 Drawing Sheets

(51) Int. Cl.
*B41F 15/08* (2006.01)
*B41F 15/20* (2006.01)

(52) U.S. Cl.
CPC ..... *B41F 15/26* (2013.01); *B41F 15/36* (2013.01); *B41P 2215/50* (2013.01)

(58) Field of Classification Search
USPC ..... 101/126
See application file for complete search history.

(56) References Cited

FOREIGN PATENT DOCUMENTS

| | | | | |
|---|---|---|---|---|
| JP | 2009248551 | A | * | 10/2009 |
| WO | 2017/022127 | | | 2/2017 |

* cited by examiner

SCREEN PRINTING APPARATUS AND SCREEN PRINTING METHOD

BACKGROUND

1. Technical Field

The present disclosure relates to a screen printing apparatus and a screen printing method for printing a paste on a workpiece, such as a board.

2. Description of the Related Art

In the field of electronic component manufacturing, screen printing is widely used as a method of printing a paste, such as a cream solder or a conductive paste, on a board. In a case where the board that is a printing target is an individual board having a small size divided into individual pieces, printing work is performed in a state where a plurality of individual boards are disposed on a carrier for handling. As a carrier used in such screen printing, a configuration in which a workpiece placer for holding the individual board on a rectangular plate member is known (for example, refer to International Publication No. 2017/022127).

In the related art illustrated in patent literature, first, among the plurality of individual boards placed on the carrier (pallet), a printing target board to be a printing target is raised from the carrier by a backup device. Next, the position detection for correctly positioning the individual board to an opening portion of a screen mask is performed, the individual board abuts against the opening portion of the screen mask based on a position detection result, and screen printing is performed on the printing target board. In addition, the series of work is sequentially executed for each of the plurality of individual boards. By using such a method, there is an advantage that it is possible to ensure high printing accuracy by compensating a positional deviation of the individual board in a state of being placed on a carrier.

SUMMARY

According to the disclosure, there is provided a screen printing apparatus including: a mask plate on which a plurality of pattern holes for printing are formed; a carrier supporter which supports a carrier through which a plurality of first openings vertically penetrate and in which a plurality of workpieces are disposed on the plurality of first openings; a backup unit which has a plurality of workpiece supporters that support the plurality of workpieces from below and have a size insertable into the plurality of first openings; a raising and lowering unit which inserts the plurality of workpiece supporters into the plurality of first openings from below, lifts up the plurality of workpieces from the carrier, and returns the plurality of lifted-up workpieces to the carrier, by relatively raising and lowering the carrier supporter and the backup unit; an aligner which aligns the plurality of workpieces lifted up by the plurality of workpiece supporters in accordance with arrangement of the plurality of pattern holes; an overlapper which relatively moves the backup unit and the mask plate for positioning and overlapping the plurality of workpieces lifted up by the raising and lowering unit and the mask plate to each other; and a print head which prints a paste on the plurality of workpieces on the plurality of workpiece supporters through the plurality of pattern holes.

According to the disclosure, there is provided a screen printing method including: a carrier carry-in step of disposing a carrier through which a plurality of first openings vertically penetrate and in which a plurality of workpieces are disposed on the plurality of first openings, below a mask plate on which a plurality of pattern holes for printing are formed; a lifting-up step of lifting up the plurality of workpieces from the carrier while supporting the plurality of workpieces by the plurality of workpiece supporters by inserting the plurality of workpiece supporters from below the plurality of first openings; an aligning step of aligning the plurality of workpieces such that arrangement of the plurality of workpieces lifted up by the plurality of workpiece supporters and arrangement of the plurality of pattern holes match with each other; an alignment step of relatively moving the plurality of workpiece supporters and the mask plate so as to position the plurality of aligned workpieces and the mask plate to each other; a printing step of printing a paste on the plurality of aligned workpieces through the plurality of pattern holes by moving a print head on an upper surface of the mask plate; and a returning step of returning the plurality of workpieces to the carrier by drawing out the plurality of workpiece supporters downward from the plurality of first openings after the printing step.

According to the disclosure, it is possible to ensure high productivity while ensuring printing accuracy by compensating a positional deviation of a workpiece placed on a carrier.

DETAILED DESCRIPTION

In the technique of the related art described in the above patent literature, due to sequential execution of a series of work steps for performing screen printing on a printing target board for each of a plurality of individual boards, there is a problem that it is difficult to improve productivity due to a delay of work time with respect to all of the plurality of individual boards. In other words, in the screen printing work, the work time in a squeegeeing operation of moving a squeegee on an upper surface of a screen mask in a state where the board abuts against a lower surface occupies a large proportion of the entire work time. Therefore, similar to the above-described technique of the related art, in a screen printing method in which squeegeeing is repeatedly executed for each of the plurality of individual boards, there is a limitation in shortening the work time and it is difficult to substantially improve the productivity. In this manner, in the technique of the related art, there is a problem that it is difficult to ensure high productivity in a method of ensuring printing accuracy by compensating a positional deviation of the workpiece, such as the individual board placed on a carrier.

Here, an object of the disclosure is to provide a screen printing apparatus and a screen printing method capable of ensuring high productivity while ensuring printing accuracy by compensating the positional deviation of the workpiece placed on the carrier.

Figure 1:
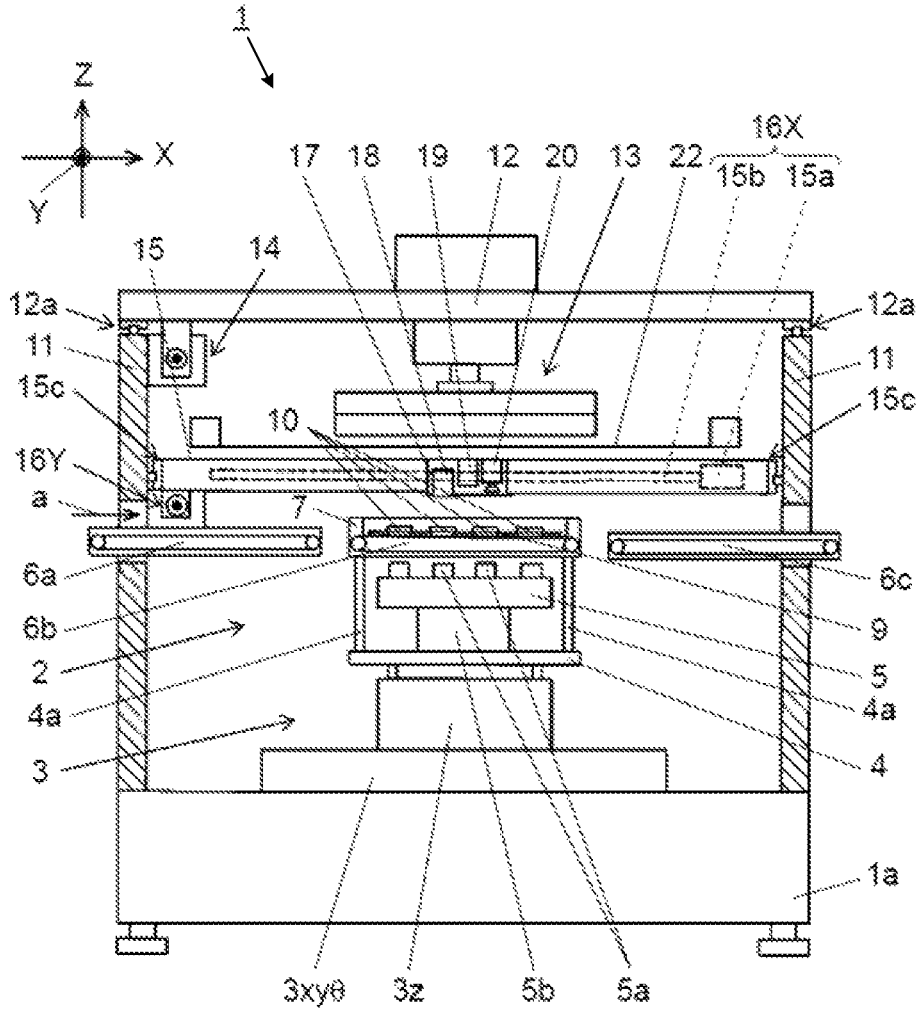
FIG. 1 is a front view of a screen printing apparatus according to an embodiment of the disclosure.
Figure 2:
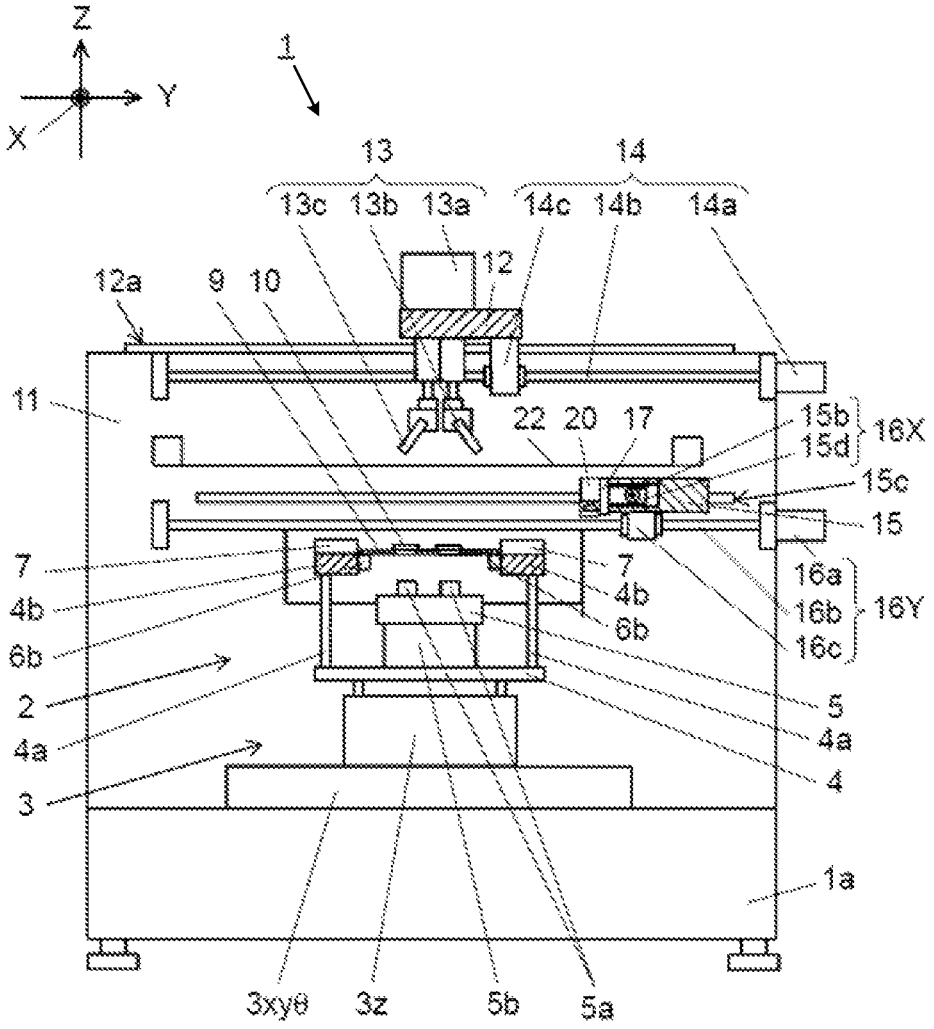
FIG. 2 is a side view of the screen printing apparatus according to the embodiment of the disclosure.

Next, embodiments of the disclosure will be described with reference to the drawings. First, with reference to FIGS. 1 and 2, the entire configuration of screen printing apparatus 1 will be described. Screen printing apparatus 1 has a function of printing a paste, such as a cream solder, on a workpiece, such as a board. In FIGS. 1 and 2, support frame 11 stands upright in both side end portions in an X direction of base 1*a*, and the following elements that configure screen printing apparatus 1 are disposed between the pair of support frames 11. In addition, in the embodiment, a left-right direction in FIG. 1, that is, a workpiece transport direction in which carrier 9 is transported on which workpiece 10 to be a target of printing work is disposed is defined as the X direction, and a direction orthogonal to the X direction is defined as a Y direction.

Figure 3:
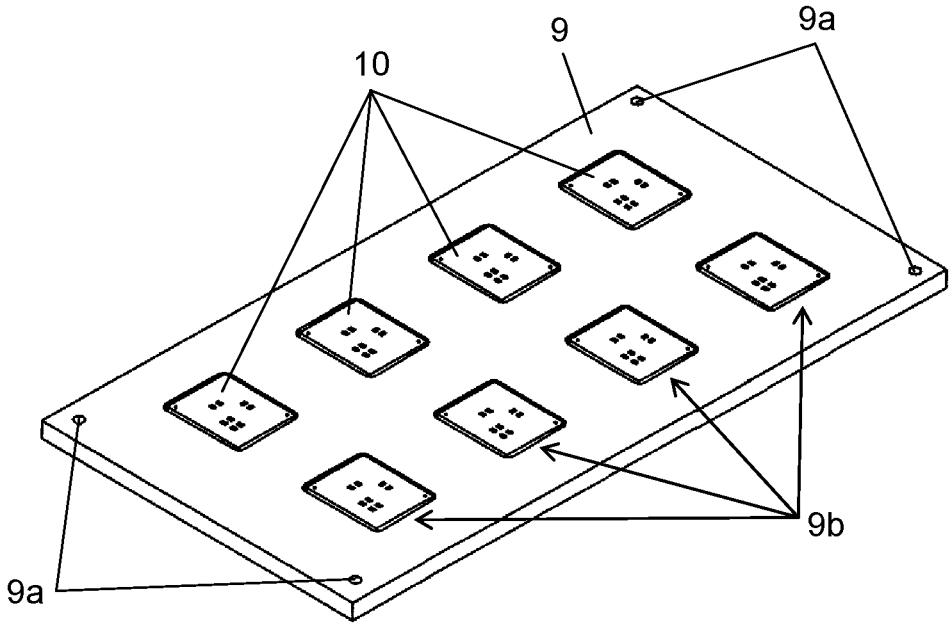
FIG. 3 is a perspective view of a carrier that holds a workpiece to be a printing target of the screen printing apparatus according to the embodiment of the disclosure.

As illustrated in FIG. 3, a pair of recognition marks 9*a* for position recognition are formed at diagonal positions on the upper surface of rectangular carrier 9. On carrier 9, a plurality of workpiece storage recess portions 9*b* for disposing workpiece 10 having a shape of a rectangular flat plate are disposed in a predetermined regular arrangement (here, a 2×4 lattice arrangement). On the upper surface of workpiece 10, as illustrated in FIG. 4, a pair of recognition marks 10*m* for position recognition are formed at diagonal positions together with the plurality of electrodes 10*a* for connection.

Figure 4:
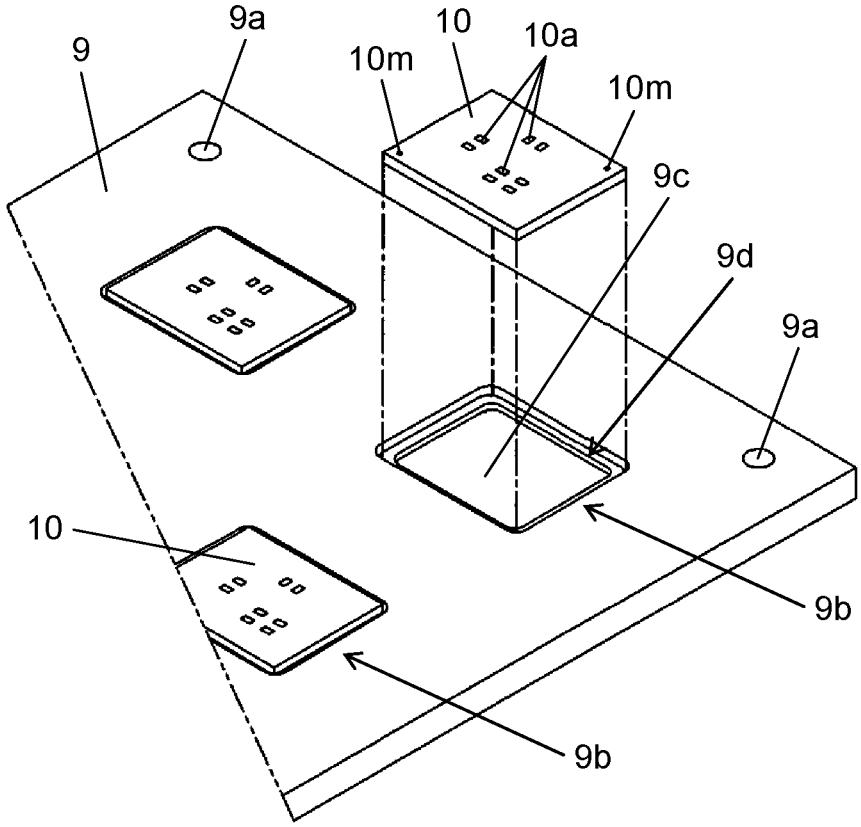
FIG. 4 is an explanatory view of workpiece holding by the carrier in the screen printing apparatus according to the embodiment of the disclosure.

As illustrated in FIG. 4, the planar shape of workpiece storage recess portion 9*b* is set to be slightly greater than an outer shape dimension of workpiece 10 so as to make it easy to accommodate and remove workpiece 10, and a state where a so-called "play" is provided is achieved. At a circumferential edge of an opening portion which is open on the upper surface of workpiece storage recess portion 9*b*, workpiece receiver 9*d* is provided against which the lower surface of workpiece 10 abuts in a state where workpiece 10 is stored.

In workpiece receiver 9*d*, first opening 9*c* that vertically penetrates carrier 9 is provided. In each of workpiece storage recess portions 9*b*, one workpiece 10 is disposed in a state of covering first opening 9*c*. In other words, carrier 9 illustrated in the embodiment has a plurality of first openings 9*c* that vertically penetrate therethrough, and a plurality of workpieces 10 are disposed so as to cover each of first openings 9*c*. In addition, when workpiece 10 is disposed so as to cover first opening 9*c* in workpiece storage recess portion 9*b* and the position of workpiece 10 is held by workpiece storage recess portion 9*b*, the upper surface of workpiece 10 may slightly protrude from workpiece storage recess portion 9*b*.

On the upper surface of base 1*a* between the pair of support frames 11, printing stage 2 that moves by printing stage moving mechanism 3 is disposed. Printing stage moving mechanism 3 has a configuration in which second raising and lowering mechanism 3*z* is stacked on printing stage XYΘ table 3*xy*θ. By driving printing stage XYΘ table 3*xy*θ, printing stage 2 horizontally moves in the X direction, in the Y direction, and in the θ direction, and printing stage 2 is raised and lowered by driving second raising and lowering mechanism 3*z*.

Printing stage 2 supports carrier 9 (refer to FIG. 3) on which workpiece 10 that is a printing target carried in from the upstream side is disposed, and performs an alignment operation by positioning and overlapping workpiece 10 carried in by carrier 9 and lifted up by workpiece supporter 5*a* of backup unit 5 with respect to the screen printing mechanism which will be described below.

At this time, by driving printing stage XYΘ table 3*xy*θ that configures printing stage moving mechanism 3, workpiece 10 is positioned with respect to mask plate 22 in the XYθ direction, and by driving second raising and lowering mechanism 3*z*, workpiece 10 abuts against the lower surface of mask plate 22 and overlaps the lower surface. Therefore, printing stage XYΘ table 3 *xy*θ configures an alignment mechanism that moves backup unit 5 in the XYθ direction.

The screen printing mechanism includes mask plate 22 on which pattern hole 22*a* (refer to FIG. 15) for printing is formed and print head 13 that performs a squeegeeing operation on mask plate 22. Printing stage 2 includes raising and lowering table 4 coupled to the upper surface of second raising and lowering mechanism 3*z*. Support member 4*a* stands upright at both ends of the upper surface of raising and lowering table 4, and as illustrated in FIG. 2, holding block 4*b* that extends in the X direction is coupled to the upper end portion of support member 4*a*. Printing stage conveyor 6*b* including a driving belt for transporting workpiece 10 is provided on an inner surface of holding block 4*b*.

On support frames 11 on the upstream side and on the downstream side of printing stage conveyor 6*b*, carry-in conveyor 6*a* and carry-out conveyor 6*c* are disposed so as to penetrate the opening portions provided in each of support frames 11. By driving printing stage moving mechanism 3, printing stage conveyor 6*b* can be connected to carry-in conveyor 6*a* and carry-out conveyor 6*c*. Carrier 9 carried in (arrow a) by carry-in conveyor 6*a* is delivered to printing stage conveyor 6*b* and held by printing stage 2. Carrier 9 after completion of the screen printing that considers workpiece 10 as a target in printing stage 2 is delivered and carried out from printing stage conveyor 6*b* to carry-out conveyor 6*c*.

On the upper surface of raising and lowering table 4, backup unit 5 that is driven to be raised and lowered by first raising and lowering mechanism 5*b* is disposed. On the upper surface of backup unit 5, a plurality of workpiece supporters 5*a* are provided in a disposition that corresponds to the arrangement (refer to FIG. 3) of workpiece storage recess portions 9*b* on carrier 9. Workpiece supporter 5*a* supports workpiece 10 from below on the upper surface thereof and has a planar size insertable from below into first opening 9*c* in workpiece storage recess portion 9*b*.

In a state where carrier 9 is carried in printing stage conveyor 6*b*, by driving first raising and lowering mechanism 5*b* and by raising backup unit 5, workpiece supporter 5*a* of backup unit 5 is inserted from below into first opening 9*c* of carrier 9. The inserted workpiece supporter 5*a* lifts up workpiece 10 disposed on carrier 9 from the lower surface side and supports workpiece 10 at a printing height position by the above-described screen printing mechanism. After the printing by the screen printing mechanism is completed, first raising and lowering mechanism 5*b* is driven again to lower backup unit 5, and return the plurality of lifted-up workpieces 10 to carrier 9.

In other words, by relatively raising and lowering a carrier supporter that supports carrier 9 and backup unit 5, first raising and lowering mechanism 5*b* inserts the plurality of workpiece supporters 5*a* from below into the plurality of first openings 9*c*, lifts up the plurality of workpieces 10 from carrier 9, and functions as a raising and lowering unit that returns the plurality of lifted-up workpieces 10 to carrier 9.

Side clamps 7 are respectively provided on the upper surfaces of a pair of holding blocks 4*b*. The side clamps 7 are freely opened and closed by side clamp driving mechanism 7*a* (refer to FIG. 6), and by causing side clamp 7 to perform a closing operation in a state where carrier 9 is received by backup unit 5, in printing stage 2, both surfaces of carrier 9 are nipped by side clamps 7 and clamp-supported. In the configuration, side clamp 7 that nips and clamps printing stage conveyor 6*b* on which carried-in carrier 9 is placed and carrier 9 in this state functions as the carrier supporter that supports carrier 9 having the above-described configuration in printing stage 2.

In workpiece storage recess portion 9*b* of carrier 9 supported by the carrier supporter, a plurality of workpieces 10 are disposed in a state where "play" is provided. Therefore, the positions of the plurality of workpieces 10 are in a state of being deviated from a regular state. Therefore, considering the plurality of workpieces 10 disposed on same carrier 9 and simultaneously lifted up by the plurality of workpiece supporters 5*a* as a target, in a work state where the printing is executed at once by same mask plate 22, alignment processing of matching the arrangement of the plurality of workpieces 10 with the arrangement of pattern holes 22*a* of mask plate 22 is necessary.

Therefore, screen printing apparatus 1 includes an aligner for executing the alignment processing for aligning the plurality of workpieces 10 in a state of being lifted up by workpiece supporter 5*a* from carrier 9 in accordance with the arrangement of pattern holes 22*a* of mask plate 22. When executing screen printing, an overlapping operation is executed in which the plurality of workpieces 10 aligned in this manner and pattern hole 22*a* of mask plate 22 are positioned and overlap each other.

In addition, on the upper surface of mask plate 22 that overlaps the plurality of workpieces 10 aligned in this manner, by performing a screen printing operation with respect to print head 13 of a screen printer which will be described below, on the plurality of workpieces 10 aligned on the plurality of workpiece supporters 5*a*, paste P is printed by print head 13 from the upper surface of mask plate 22 through pattern hole 22*a*.

In FIG. 1, print head support beam 12 that supports print head 13 is disposed at the upper ends of the pair of support frames 11 to freely move in the Y direction via linear motion guide mechanism 12*a*. One end portion of print head support beam 12 is coupled to one support frame 11 via print head moving mechanism 14 having the configuration illustrated in FIG. 2. Print head moving mechanism 14 has a configuration in which nut portion 14*c* to which feed screw 14*b* that is rotationally driven by print head motor 14*a* is screwed is coupled to print head support beam 12. By driving print head motor 14*a* forward and backward, print head 13 supported by print head support beam 12 reciprocates in the Y direction which is the squeegeeing direction.

As illustrated in FIG. 2, print head 13 includes a pair of rear squeegees 13*b* and front squeegee 13*c* which are provided to extend downward from print head support beam 12. By driving squeegee driver 13*a* provided on the upper surface of print head support beam 12, any one of rear squeegee 13*b* and front squeegee 13*c* is lowered in accordance with the squeegeeing direction and comes into sliding contact with mask plate 22.

In mask plate 22, pattern hole 22*a* for printing is formed corresponding to print pattern (refer to FIG. 15) in workpiece 10 that is a printing target. In the screen printing in screen printing apparatus 1, paste P (refer to FIGS. 17A and 17B) for printing is supplied to the upper surface of mask plate 22. Next, the plurality of workpieces 10 in a state of being disposed on carrier 9 is lifted up and supported by workpiece supporter 5*a*, and workpiece 10 which is a printing target abuts against the lower surface of mask plate 22.

In addition, in the state, the squeegeeing operation is performed to slide either rear squeegee 13*b* or front squeegee 13*c* on the upper surface of mask plate 22. Accordingly, paste P is printed on workpiece 10 which is a printing target with a predetermined print pattern through pattern hole 22*a*. In other words, print head 13 prints paste P through pattern hole 22*a* from the upper surface of mask plate 22 to the plurality of workpieces 10 on workpiece supporter 5*a* of backup unit 5.

Between the upper surface of printing stage 2 and the lower surface of mask plate 22, a moving mechanism (refer to camera moving mechanism 16 illustrated in FIG. 6) that moves moving member 17 to which first camera 18, second camera 19, and workpiece pickup unit 20 are attached, is disposed in the X direction and in the Y direction. The moving mechanism is configured with camera X-axis moving mechanism 16X that moves moving member 17 along camera X-axis beam 15 in the X direction and camera Y-axis moving mechanism 16Y that moves camera X-axis beam 15 in the Y direction.

The movement of camera X-axis beam 15 in the Y direction is guided by linear motion guide mechanism 15*c* disposed on the inner surface of support frame 11. In other words, the above-described moving mechanism includes moving member 17 that moves in a space between mask plate 22 and printing stage conveyor 6*b* which is the carrier supporter, and first camera 18, second camera 19, and workpiece pickup unit 20 are installed in moving member 17.

Camera X-axis moving mechanism 16X is configured with camera X-axis motor 15*a* illustrated in FIG. 1, feed screw 15*b*, and nut portion 15*d* illustrated in FIG. 2. By driving camera X-axis motor 15*a*, moving member 17 coupled to nut portion 15*d* moves in the X direction. In addition, in FIG. 2, camera X-axis motor 15*a* is omitted in the drawing. As illustrated in FIG. 2, camera Y-axis moving mechanism 16Y includes camera Y-axis motor 16*a*, feed screw 16*b*, and nut portion 16*c* coupled to camera X-axis beam 15. By driving camera Y-axis motor 16*a*, camera X-axis beam 15 coupled to nut portion 16*c* moves in the Y direction.

Here, the functions of first camera 18, second camera 19, and workpiece pickup unit 20 will be described. First camera 18 is disposed with an imaging direction thereof being oriented downward, and images carrier 9 and workpiece 10 held by carrier 9 in printing stage 2. Here, recognition mark 9*a* formed on carrier 9 and recognition mark 10*m* (refer to FIG. 4) formed on workpiece 10 are imaging targets.

In the embodiment, carrier 9 has only a function of holding workpiece 10, carrying workpiece 10 into printing stage 2, and similarly holding and carrying out workpiece 10 after the printing. Therefore, with respect to carrier 9, as long as the position accuracy with which workpiece 10 can be stored on carrier 9 within a preset "play" range is ensured, accuracy more than that is not necessary, and position recognition is not necessary, either.

Figure 6:
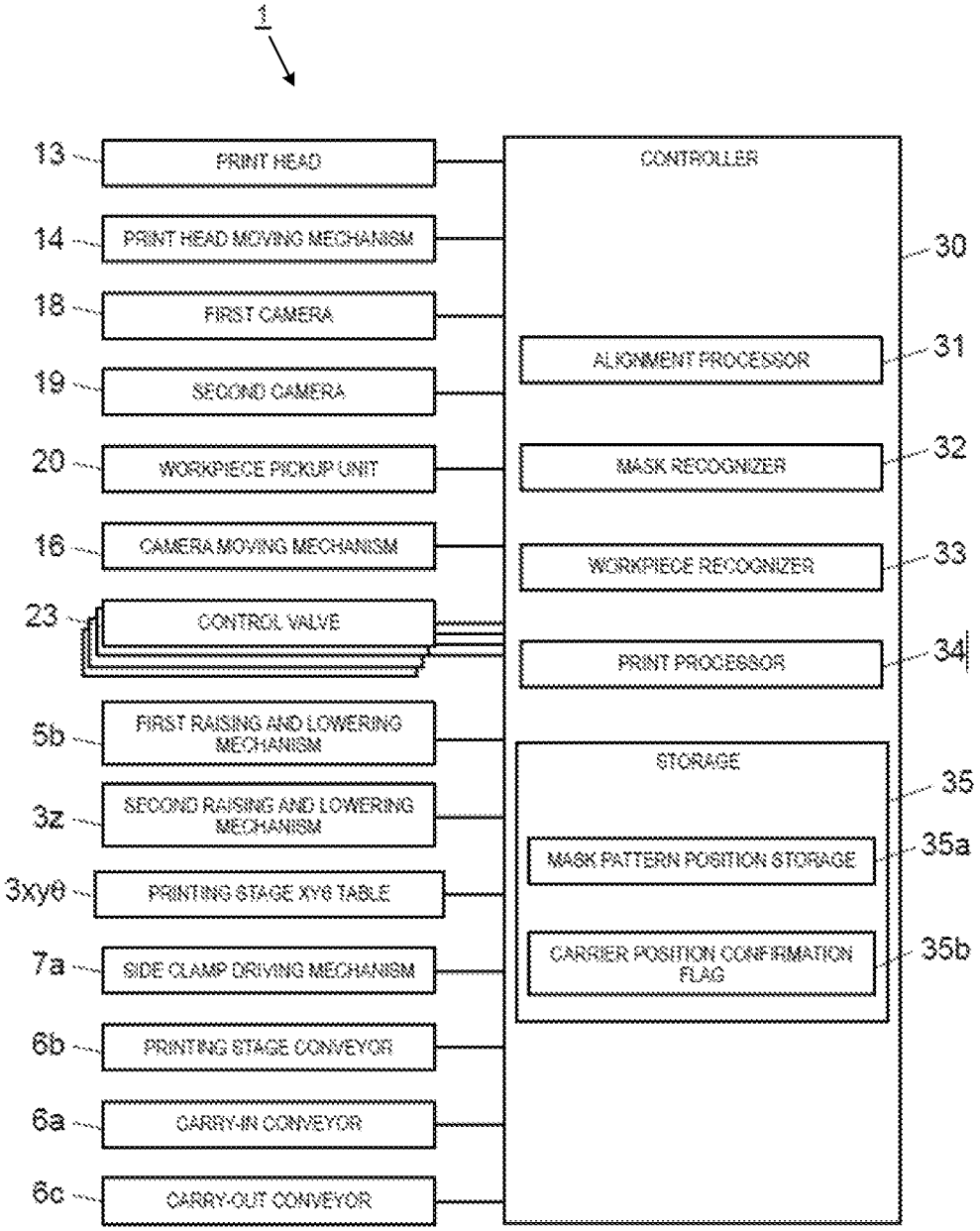
FIG. 6 is a block diagram illustrating a configuration of a control system of the screen printing apparatus according to the embodiment of the disclosure.
Figure 7:
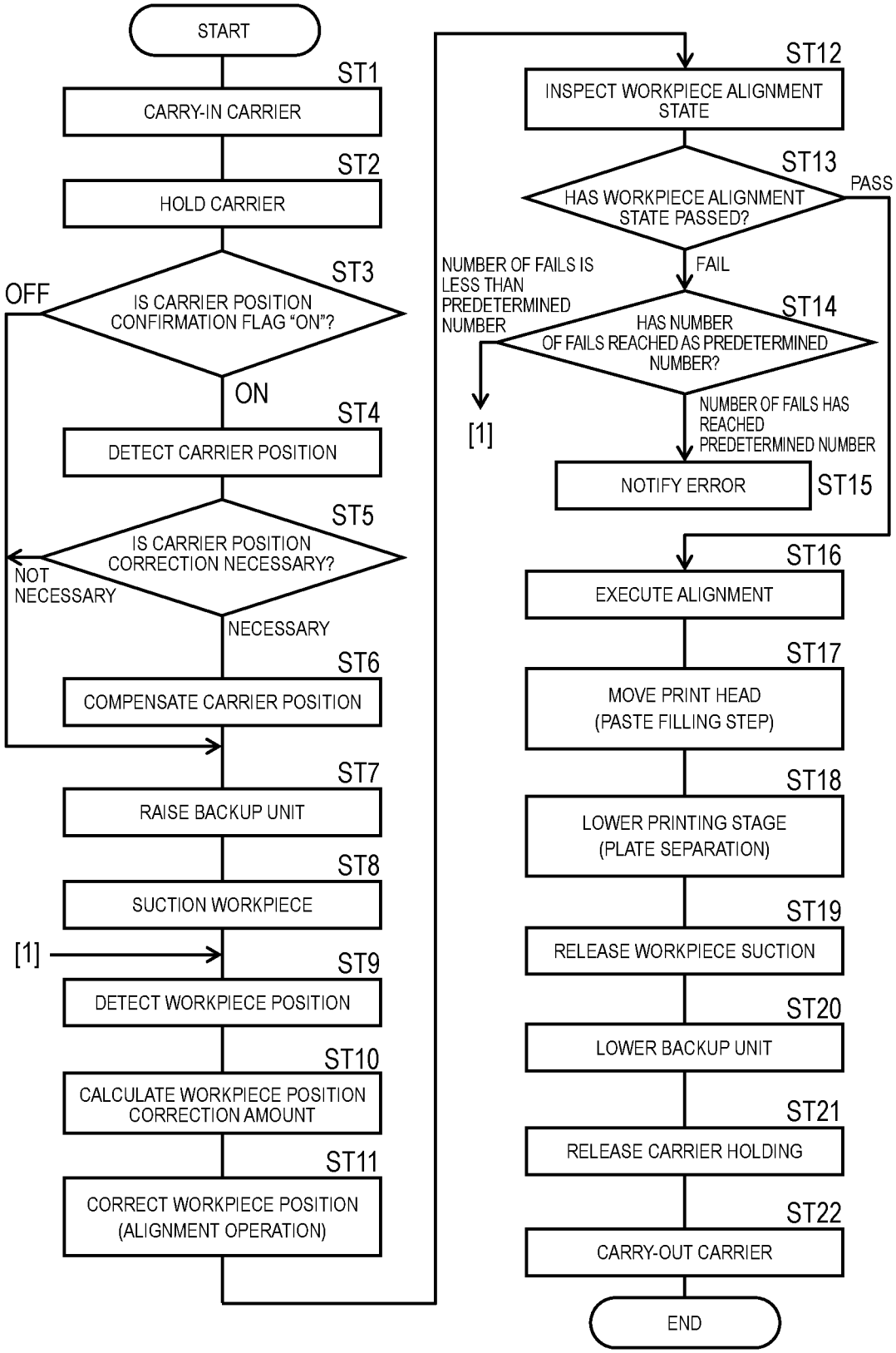
FIG. 7 is a flowchart of a screen printing method according to the embodiment of the disclosure.

Therefore, with respect to carrier 9, only in a case where it is detected that carrier position confirmation flag 35*b* is ON in the work operation (that is, a case where a combination of carrier 9 and workpiece 10 is considered as a work target such that it is required to hold the position of carrier 9 within the predetermined range in order to lift up workpiece 10 from carrier 9), recognition mark 9*a* of carrier 9 is the imaging target for position confirmation (refer to FIG. 7). Therefore, in the embodiment, it is determined in advance whether or not the position confirmation is necessary for carrier 9 and the determination result is stored as carrier position confirmation flag 35*b* (refer to FIG. 6) for each type of carrier 9.

By recognizing the image obtained by the imaging by first camera 18 by the processing function of workpiece recognizer 33 (refer to FIG. 6), in addition to the positional deviation or propriety of the direction of carrier 9 and workpiece 10, the position of electrode 10*a* is detected in workpiece 10. Therefore, first camera 18 and workpiece recognizer 33 correspond to a workpiece position detector which images the plurality of workpieces 10 on the plurality of workpiece supporters 5*a* by first camera 18, detects the position thereof, and detects the positional deviation from the ideal position of each of workpieces 10.

Second camera 19 is disposed with the imaging direction being oriented upward, and images mask recognition mark 22*m* formed on mask plate 22. By recognizing the image obtained by the imaging by the processing function of mask recognizer 32 (refer to FIG. 6), the position of mask center MC or pattern hole 22*a* in mask plate 22 is recognized (refer to FIG. 15). Therefore, second camera 19 and mask recognizer 32 correspond to a mask position detector which detects the position by imaging mask plate 22 with second camera 19.

Workpiece pickup unit 20 is a suction holding tool having a function of holding workpiece 10 by vacuum suction, and in the embodiment, is used for picking up at least one of the plurality of workpieces 10 supported by workpiece supporter 5*a*, from workpiece supporter 5*a*. Accordingly, it is possible to temporarily pick up workpiece 10 disposed in the positional deviation state in workpiece supporter 5*a* and to perform a workpiece alignment operation of returning workpiece 10 in a state where the positional deviation is compensated with respect to the workpiece supporter 5*a*.

The workpiece alignment operation is performed by relatively moving printing stage 2 including workpiece supporter 5*a* in the horizontal direction by printing stage XYΘ table 3*xy*θ by an amount of compensation which is necessary for compensating the detected positional deviation state, with respect to workpiece 10 picked up by workpiece pickup unit 20 based on the position (positional deviation state) of workpiece 10 detected by the above-described workpiece position detector.

In other words, printing stage XYΘ table 3*xy*θ which relatively moves printing stage 2 in the horizontal direction functions as a workpiece alignment mechanism that relatively moves workpiece pickup unit 20 and workpiece supporter 5*a* in the XYθ direction based on the positional deviation of workpiece 10 detected by the above-described workpiece position detector. In addition, in the embodiment, the aligner for aligning the plurality of workpieces 10 lifted up by workpiece supporter 5*a* in accordance with the arrangement of pattern holes 22*a* of mask plate 22 includes the above-described workpiece position detector, workpiece pickup unit 20, and the above-described workpiece alignment mechanism.

When executing the alignment operation, it is necessary to move first camera 18 and workpiece pickup unit 20 in the space between mask plate 22 and the carrier supporter (printing stage conveyor 6*b* and side clamp 7) provided on printing stage 2. The above-described camera moving mechanism 16 (refer to FIG. 6) including camera X-axis moving mechanism 16X and camera Y-axis moving mechanism 16Y moves first camera 18 and workpiece pickup unit 20 in the space between mask plate 22 and the carrier supporter. In the embodiment, a configuration in which moving member 17 which is moved by camera X-axis moving mechanism 16X and camera Y-axis moving mechanism 16Y is provided in the space between mask plate 22 and the carrier supporter, is achieved, and first camera 18 and workpiece pickup unit 20 are installed on moving member 17.

In the above-described configuration, the above-described overlapper which relatively moves backup unit 5 and mask plate 22 in order to position and overlap the plurality of workpieces 10 lifted up by the plurality of workpiece supporters 5*a* and mask plate 22 to each other, includes printing stage XYΘ table 3*xy*θ which is an alignment mechanism that configures printing stage moving mechanism 3. In addition, in the embodiment, the alignment mechanism functions as the above-described workpiece alignment mechanism. In other words, here, the alignment mechanism concurrently serves as a workpiece alignment mechanism.

In this manner, in the embodiment, by utilizing the printing stage XYΘ table 3*xy*θ which is an existing alignment mechanism for moving printing stage 2 as the workpiece alignment mechanism having the above-described function, it is possible to effectively utilize the existing mechanism and to reduce the cost. In addition, as a configuration example of the workpiece alignment mechanism having the above-described function, in addition to the configuration example described in the embodiment, by additionally adding a new function to the existing mechanism, various variations that realize a function equivalent to that of the configuration example described in the embodiment are possible.

For example, as a configuration example (1) of the workpiece alignment mechanism that relatively moves backup unit 5 and the carrier supporter in the XYθ direction, and an XY table of printing stage XYΘ table 3*xy*θ is used in the XY direction, and the θ table of printing stage XYΘ table 3*xy*θ is used in the θ direction. In addition, as a configuration example (2) of the workpiece alignment mechanism, the moving mechanism (refer to camera moving mechanism 16 illustrated in FIG. 6) that moves moving member 17 in the XY direction is used, and a Θ rotation mechanism which is newly provided in workpiece pickup unit 20 is used in the θ direction.

Next, as a configuration example (3), the moving mechanism (camera moving mechanism 16) that moves moving member 17 in the XY direction similar to the configuration example (2) is used, and the Θ table of printing stage XYΘ table 3*xy*θ is used in the θ direction. Furthermore, as a configuration example (4), the XY table of printing stage XYΘ table 3*xy*θ is used in the XY direction similar to the configuration example (1), and the Θ rotation mechanism which is newly provided in workpiece pickup unit 20 is used in the θ direction.

Figure 5:
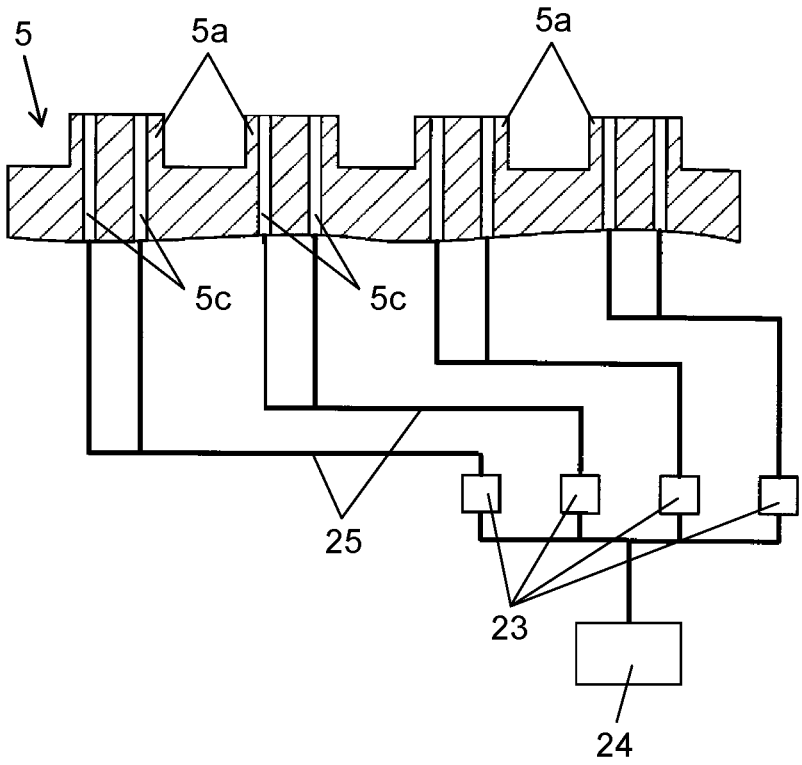
FIG. 5 is an explanatory view of suction holding of a workpiece in a workpiece supporter of the screen printing apparatus according to the embodiment of the disclosure.

Next, with reference to FIG. 5, holding workpiece 10 by vacuum suction in backup unit 5 will be described. In the plurality of workpiece supporters 5*a* formed on the upper surface of backup unit 5, suction paths 5*c* that are open on the upper surface are provided. In a state where workpiece 10 is lifted up and held by the upper surface of workpiece supporter 5*a*, suction path 5*c* abuts against the lower surface of workpiece 10. The suction paths 5*c* that correspond to each workpiece storage recess portion 9*b* are connected to negative pressure generation source 24 via control valve 23.

Control valve 23 has a function as an on-off valve that connects and disconnects suction circuit 25 between negative pressure generation source 24 and suction path 5*c* and a function as a vacuum break valve that introduces the atmosphere into suction circuit 25 which is in a negative pressure state. By individually controlling control valve 23 by controller 30 (FIG. 6), it is possible to select introduction and block of the negative pressure to suction path 5*c* for each of the plurality of workpiece storage recess portions 9*b* provided on carrier 9.

In a state where workpiece 10 is lifted up by the upper surface of workpiece supporter 5*a*, negative pressure generation source 24 is operated and control valve 23 is an open state, and accordingly, vacuum suction is performed from suction path 5*c* via suction circuit 25. Accordingly, workpiece 10 lifted up by each workpiece supporter 5*a* is restrained and held on workpiece supporter 5*a* by vacuum suction. When releasing the vacuum suction to workpiece supporter 5*a* of workpiece 10, control valve 23 is controlled such that suction circuit 25 is in a closed state with respect to negative pressure generation source 24 and is in an open state to the atmosphere.

In other words, in the above-described configuration, suction path 5*c* formed in backup unit 5 including the plurality of workpiece supporters 5*a*, suction circuit 25 that connects suction path 5*c* and negative pressure generation source 24 to each other, and control valve 23 and negative pressure generation source 24 which are interposed in suction circuit 25, configure a workpiece suctioner which includes each of workpiece supporters 5*a* and holds workpiece 10 under the negative pressure. In addition, the workpiece suctioner is configured to be able to select introduction and block of the negative pressure for each of workpiece supporters 5*a*.

Further, at least workpiece pickup unit 20 lifts up workpiece 10 of workpiece supporter 5*a* in which the negative pressure has been blocked. With such a configuration, among the plurality of workpieces 10 disposed and carried in each of workpiece storage recess portions 9*b* of same carrier 9 and further lifted up at once by workpiece supporter 5*a*, it is possible to lift up any one workpiece 10 by workpiece pickup unit 20 from workpiece supporter 5*a*, and to suction hold the workpiece 10 by returning the workpiece 10 to workpiece supporter 5*a*.

Next, with reference to FIG. 6, the configuration of a control system of screen printing apparatus 1 will be described. In FIG. 6, print head 13, print head moving mechanism 14, first camera 18, second camera 19, workpiece pickup unit 20, camera moving mechanism 16, control valve 23, first raising and lowering mechanism 5*b*, second raising and lowering mechanism 3*z*, printing stage XYΘ table 3*xy*θ, side clamp driving mechanism 7*a*, printing stage conveyor 6*b*, carry-in conveyor 6*a*, and carry-out conveyor 6*c* are connected to controller 30.

In addition, controller 30 includes alignment processor 31, mask recognizer 32, workpiece recognizer 33, and print processor 34, as internal processing functions. Furthermore, controller 30 includes storage 35 for storing information necessary for control processing by the members. Storage 35 has mask pattern position storage 35*a* and carrier position confirmation flag 35*b*. Mask pattern position storage 35*a* stores positional information of mask reference mark 22*m* and pattern hole 22*a* in mask plate 22.

Carrier position confirmation flag 35*b* is a signal that prescribes in advance whether or not carrier 9 to be the work target requires position confirmation in an ON-OFF flag format. When carrier position confirmation flag 35*b* is ON for carrier 9 which has been carried in and held, it is determined that carrier position confirmation processing is necessary for carrier 9, and carrier position detection and, if necessary, carrier position compensation processing is executed. Meanwhile, when carrier position confirmation flag 35*b* is OFF, carrier position confirmation is skipped for carrier 9.

Alignment processor 31 performs processing for correctly aligning the plurality of workpieces 10 disposed on carrier 9 held by the carrier holder provided on printing stage 2, in accordance with the arrangement of pattern holes 22*a* of mask plate 22. Mask recognizer 32 detects the positions of mask reference mark 22*m* and pattern hole 22*a* by recognizing the image obtained by the imaging by second camera 19. The workpiece recognizer 33 detects the positions of carrier 9 and workpiece 10 disposed on carrier 9 by recognizing the image obtained by the imaging by first camera 18.

In the alignment processing by alignment processor 31, in a state where workpiece 10 is lifted up by workpiece pickup unit 20, by driving printing stage XYΘ table 3*xy*θ based on the positional deviation of workpiece 10 detected by workpiece recognizer 33, the workpiece alignment operation of relatively moving workpiece supporter 5*a* of backup unit 5 with respect to picked-up workpiece 10 is executed.

Print processor 34 controls each unit of screen printing apparatus 1 to perform processing of executing the screen printing with respect to the plurality of workpieces 10 held in workpiece supporter 5*a*. As print processor 34 controls control valve 23, first raising and lowering mechanism 5*b*, second raising and lowering mechanism 3*z*, printing stage XYΘ table 3*xy*θ, side clamp driving mechanism 7*a*, printing stage conveyor 6*b*, carry-in conveyor 6*a*, and carry-out conveyor 6*c*, each of the following processing is executed.

In other words, each operation, such as the carry-in of carrier 9 on which workpiece 10 that is a printing target is disposed into printing stage 2, the holding of carrier 9 by the carrier supporter configured with printing stage conveyor 6*b* and side clamp 7, the overlapping of the plurality of workpieces 10 lifted up from carrier 9 by workpiece supporter 5*a* of backup unit 5 and mask plate 22 each other, the printing of paste P to workpiece 10 by print head 13 and print head moving mechanism 14, and the carry-out of carrier 9 after the screen printing, is executed.

Figure 8:
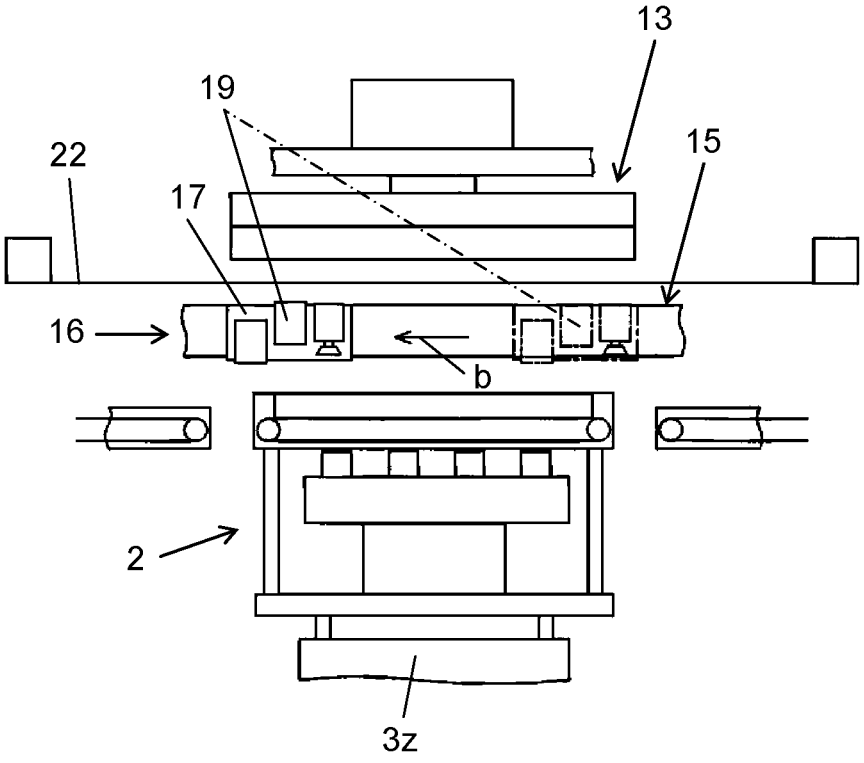
FIG. 8 is an operation explanatory view illustrating the screen printing method according to the embodiment of the disclosure.

Next, the screen printing method executed by screen printing apparatus 1 will be described with reference to the processing flow illustrated in FIG. 7 and each of the drawings. First, in a preparation stage prior to the execution of the screen printing operation, a mask recognition step is executed. In other words, as illustrated in FIG. 8, second camera 19 is moved (arrow b) by camera moving mechanism 16 below mask plate 22 and images mask reference mark 22*m* (refer to FIG. 15) of mask plate 22 by second camera 19.

In addition, by recognizing the image obtained by the imaging by mask recognizer 32, the position of mask plate 22 and the arrangement of pattern holes 22*a* are detected, and the detection result is stored in mask pattern position storage 35*a* of storage 35. Accordingly, the position coordinates of mask center MC (refer to FIG. 15) of mask plate 22 and the orientation of mask plate 22 in the θ direction are detected and stored. In the following screen printing operation, workpiece 10 is positioned based on the positional information of mask plate 22 stored in mask pattern position storage 35*a*.

Figure 9:
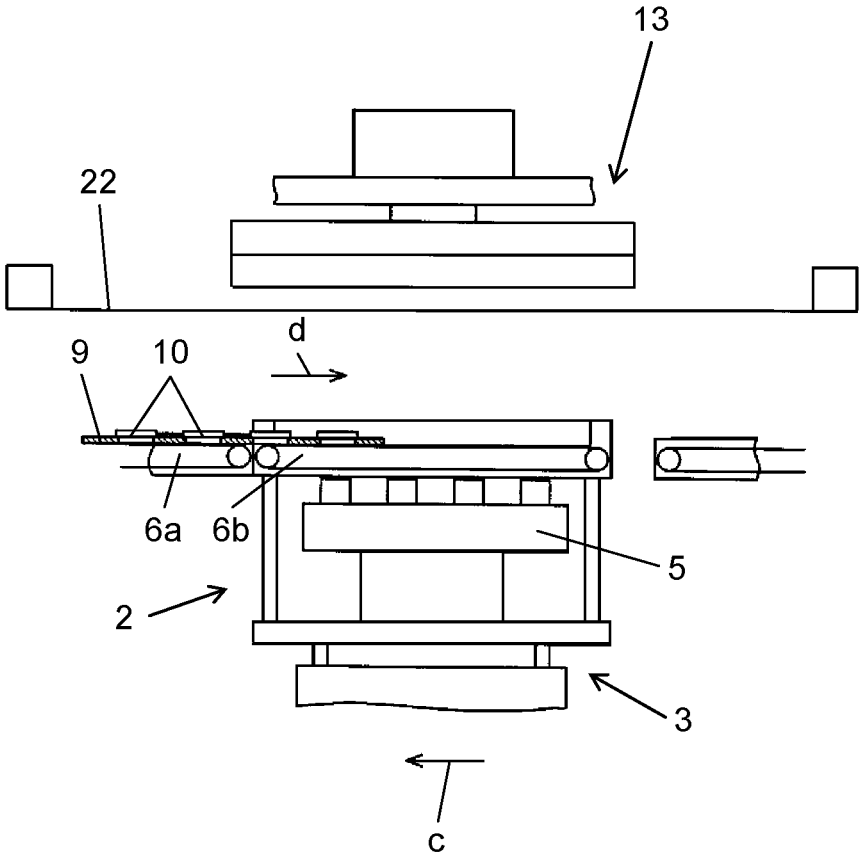
FIG. 9 is an operation explanatory view illustrating the screen printing method according to the embodiment of the disclosure.

When the screen printing operation is started, carrier carry-in is executed (ST1). First, as illustrated in FIG. 9, printing stage moving mechanism 3 is driven to move printing stage 2 to the upstream side (arrow c), and printing stage conveyor 6*b* is in a state of being connected to carry-in conveyor 6*a*. Next, printing stage conveyor 6*b* and carry-in conveyor 6*a* are driven and carrier 9 on which workpiece 10 is disposed and which is in a standby state on carry-in conveyor 6*a* is transferred to printing stage conveyor 6*b* (arrow d).

Figure 10:
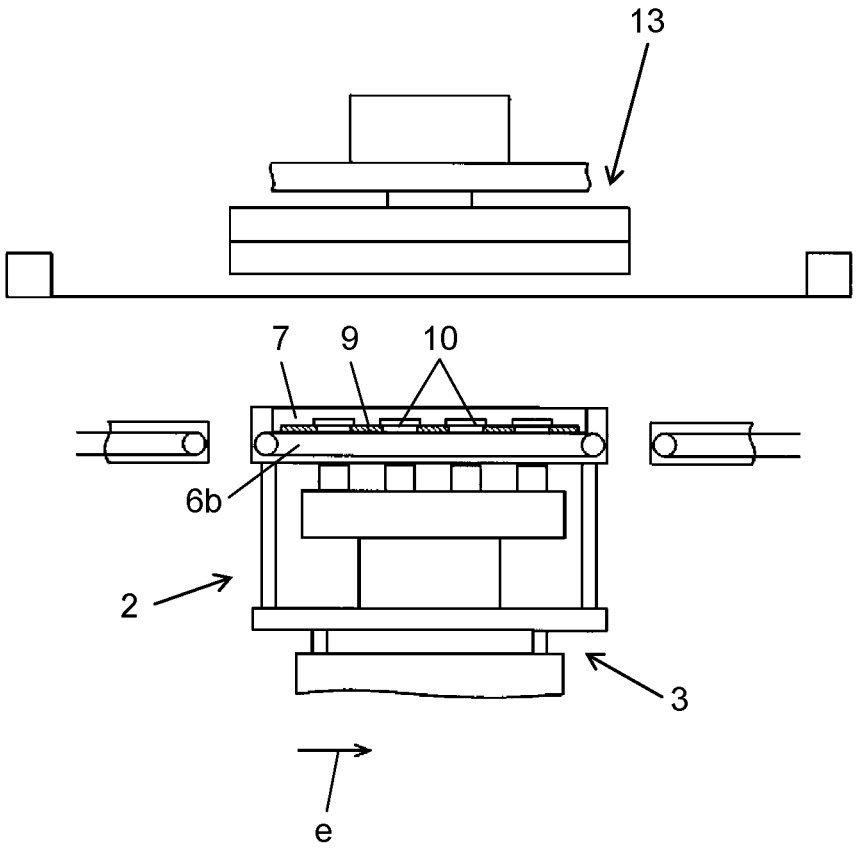
FIG. 10 is an operation explanatory view illustrating the screen printing method according to the embodiment of the disclosure.

Next, as illustrated in FIG. 10, printing stage moving mechanism 3 is driven to move printing stage 2 to the center printing position of mask plate 22 (arrow e), and carrier 9 on which workpiece 10 is disposed is disposed below mask plate 22. In other words, in a carrier carry-in step, the plurality of first openings 9*c* that vertically penetrate are provided below mask plate 22 on which the plurality of pattern holes 22*a* for printing are formed, and carrier 9 on which the plurality of workpieces 10 are disposed is disposed to cover each of first openings 9*c* (refer to FIG. 4).

Next, carrier holding is executed (ST2). Here, a carrier positioning mechanism (not illustrated), such as a transfer stopper provided on printing stage conveyor 6*b*, is operated to position carrier 9 in the transport direction, and side clamp driving mechanism 7*a* (refer to FIG. 6) is driven to nip and clamp carrier 9 by side clamp 7. Accordingly, carrier 9 is placed in a state where the position thereof is held by the carrier supporter configured with printing stage conveyor 6*b* and side clamp 7.

Figure 14A:
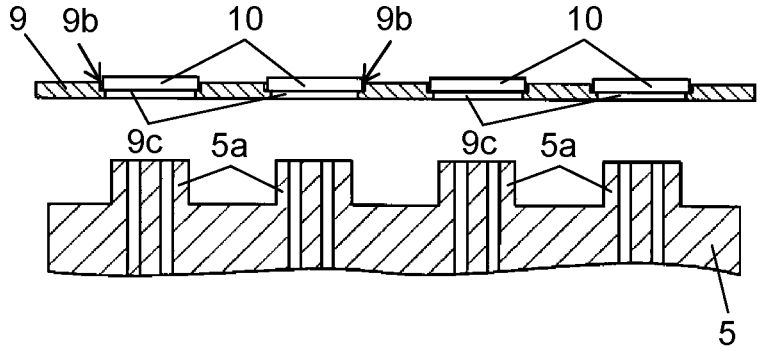
FIG. 14A is an explanatory view of positioning the workpiece and a mask plate in the screen printing method according to the embodiment of the disclosure.

FIG. 14A illustrates carrier 9 disposed in this manner, and in workpiece storage recess portion 9*b* of carrier 9, carrier 9 which covers first opening 9*c* and has workpiece 10 disposed thereon is positioned above backup unit 5. In addition, each of workpiece supporters 5*a* is positioned below first opening 9*c* on carrier 9.

Next, with reference to storage 35, it is confirmed whether or not carrier position confirmation flag 35*b* is "ON" (ST3). Here, in a case where it is confirmed that carrier position confirmation flag 35*b* is "ON", it is determined that the position confirmation in printing stage 2 is necessary for carrier 9, and carrier position detection is performed (ST4).

Figure 11:
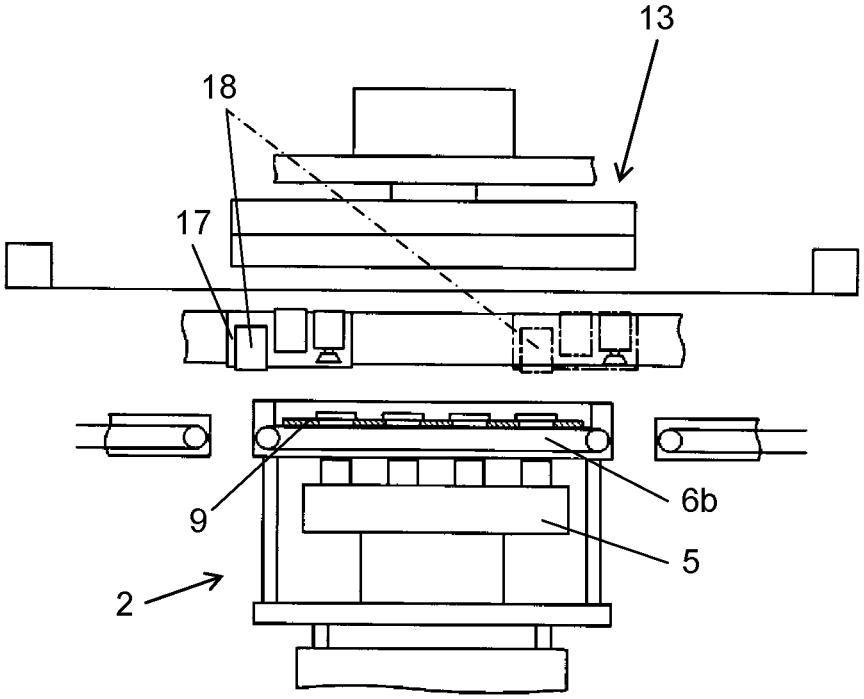
FIG. 11 is an operation explanatory view illustrating the screen printing method according to the embodiment of the disclosure.

In other words, as illustrated in FIG. 11, recognition mark 9*a* of carrier 9 is imaged by first camera 18, and the image obtained by the imaging is recognized by workpiece recognizer 33 to detect the position of carrier 9. In addition, from the detection result, it is determined whether or not the position compensation of carrier 9 is necessary (ST5). Here, in a case where it is determined that the positional deviation of carrier 9 exceeds an allowable amount and the compensation is necessary, the relative positional deviation of carrier 9 with respect to backup unit 5 is corrected (ST6). Here, printing stage conveyor 6*b* is driven to move carrier 9 in the transport direction to correct the positional deviation.

Figure 12:
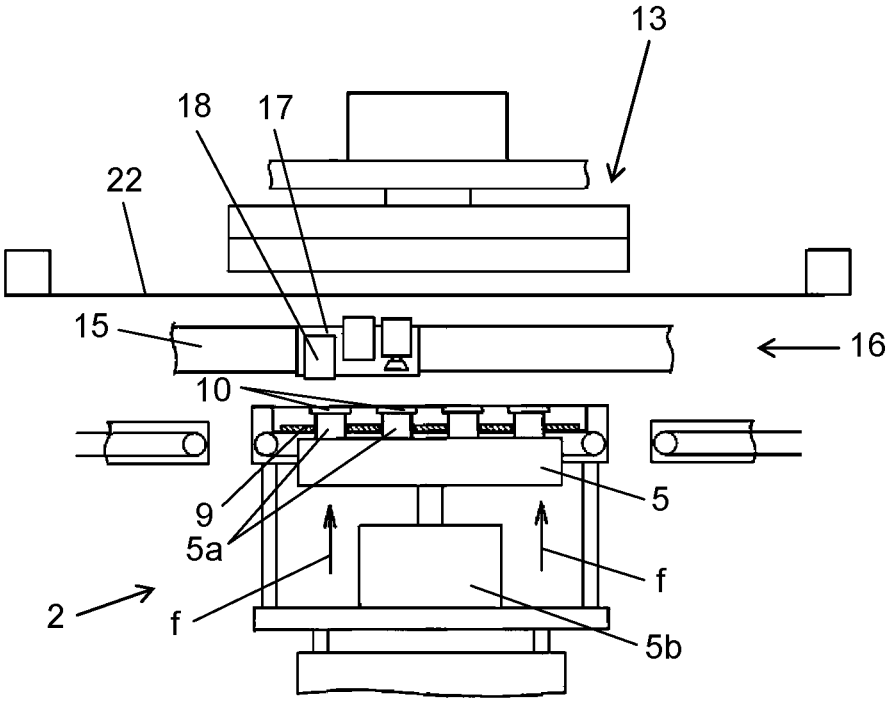
FIG. 12 is an operation explanatory view illustrating the screen printing method according to the embodiment of the disclosure.
Figure 14B:
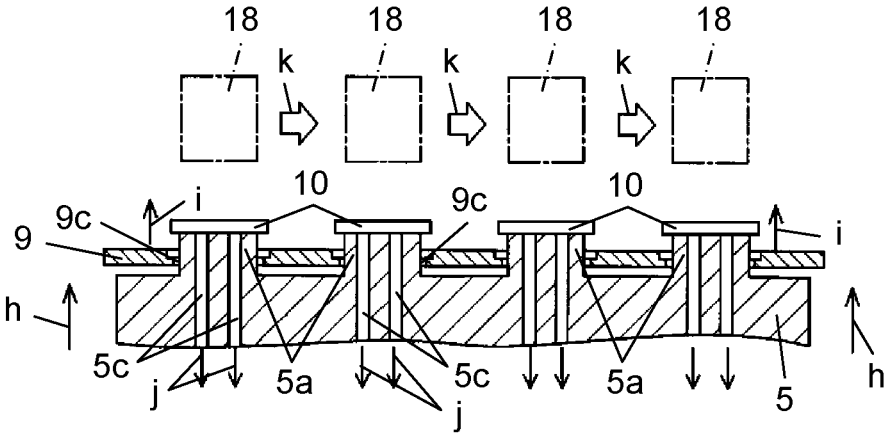
FIG. 14B is an explanatory view of positioning the workpiece and the mask plate in the screen printing method according to the embodiment of the disclosure.

Next, with respect to carrier 9 of which the position is held on printing stage 2, backup unit 5 is raised (ST7). In other words, as illustrated in FIGS. 12 and 14B, first raising and lowering mechanism 5*b* is driven to raise backup unit 5 (raising of backup unit: arrows f and h), and the plurality of workpiece supporters 5*a* are inserted into the plurality of first openings 9*c* (refer to FIG. 4) from below. In addition, in a case where carrier position confirmation flag 35*b* is "OFF" in (ST3) or in a case where it is determined that the position compensation of carrier 9 is unnecessary in (ST4), any of (ST4) to (ST6) processing is skipped, and the processing proceeds to (ST7) as it is.

Accordingly, the plurality of workpieces 10 are supported by the plurality of workpiece supporters 5*a* and lifted up from carrier 9 (lifting-up step: arrow Next, workpiece suction is executed (ST8). In other words, by driving negative pressure generation source 24 to perform vacuum suction from suction path 5*c* (arrow j), workpiece 10 is restrained by suction on the upper surface of workpiece supporter 5*a*. In addition, in this manner, considering workpiece 10 lifted up by workpiece supporter 5*a* of backup unit 5 as a target, an aligning step described below is executed. In other words, the plurality of workpieces 10 are aligned such that the arrangement of the plurality of workpieces 10 lifted up by the plurality of workpiece supporters 5*a* and the arrangement of the plurality of pattern holes 22*a* in mask plate 22 match with each other (aligning step).

The aligning step is executed as follows. First, the workpiece position detection for detecting the positions of the plurality of workpieces 10 on carrier 9 is executed (ST9) (workpiece position detecting step). In other words, as illustrated in FIG. 12, camera moving mechanism 16 is driven to move moving member 17 along camera X-axis beam 15. Accordingly, as illustrated in FIG. 14B, first camera 18 is sequentially moved (arrow k) above the plurality of workpieces 10 lifted up by the plurality of workpiece supporters 5*a*, and images two recognition marks 10*m* formed in workpiece 10 (refer to FIG. 4). In addition, by recognizing the image obtained by the imaging by workpiece recognizer 33, the positional deviation state of each of workpieces 10 is detected.

Figure 14C:
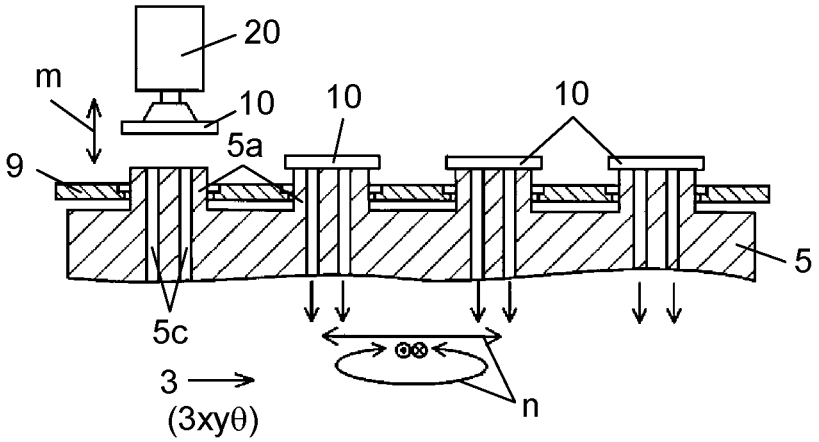
FIG. 14C is an explanatory view of positioning the workpiece and the mask plate in the screen printing method according to the embodiment of the disclosure.

In addition, FIG. 14C illustrates the workpiece position correction (alignment operation) which is executed after the workpiece position detection on workpiece 10 held in all of the plurality of workpiece supporters 5*a* of backup unit 5 is completed. In other words, after the workpiece position detecting step illustrated in (ST9), workpiece position correction amount calculation described below is executed (ST10). In addition, based on the result of the workpiece position correction amount calculation, the workpiece position correction (alignment operation) (ST11) is executed to make the arrangement of workpieces 10 in backup unit 5 and the arrangement of pattern holes 22*a* in mask plate 22 match with each other.

In the alignment operation, as illustrated in FIG. 14C, workpiece 10 is picked up from workpiece supporter 5*a* by workpiece pickup unit 20 (arrow m), and based on the workpiece position correction amount calculation result with respect to workpiece 10, the position correction (arrow n) in the XYθ direction is performed by driving printing stage moving mechanism 3. In addition, after the position correction is completed, a placing step of placing workpiece 10 picked up by workpiece pickup unit 20 on workpiece supporter 5*a* and returning the workpiece 10 is executed.

Figure 15:
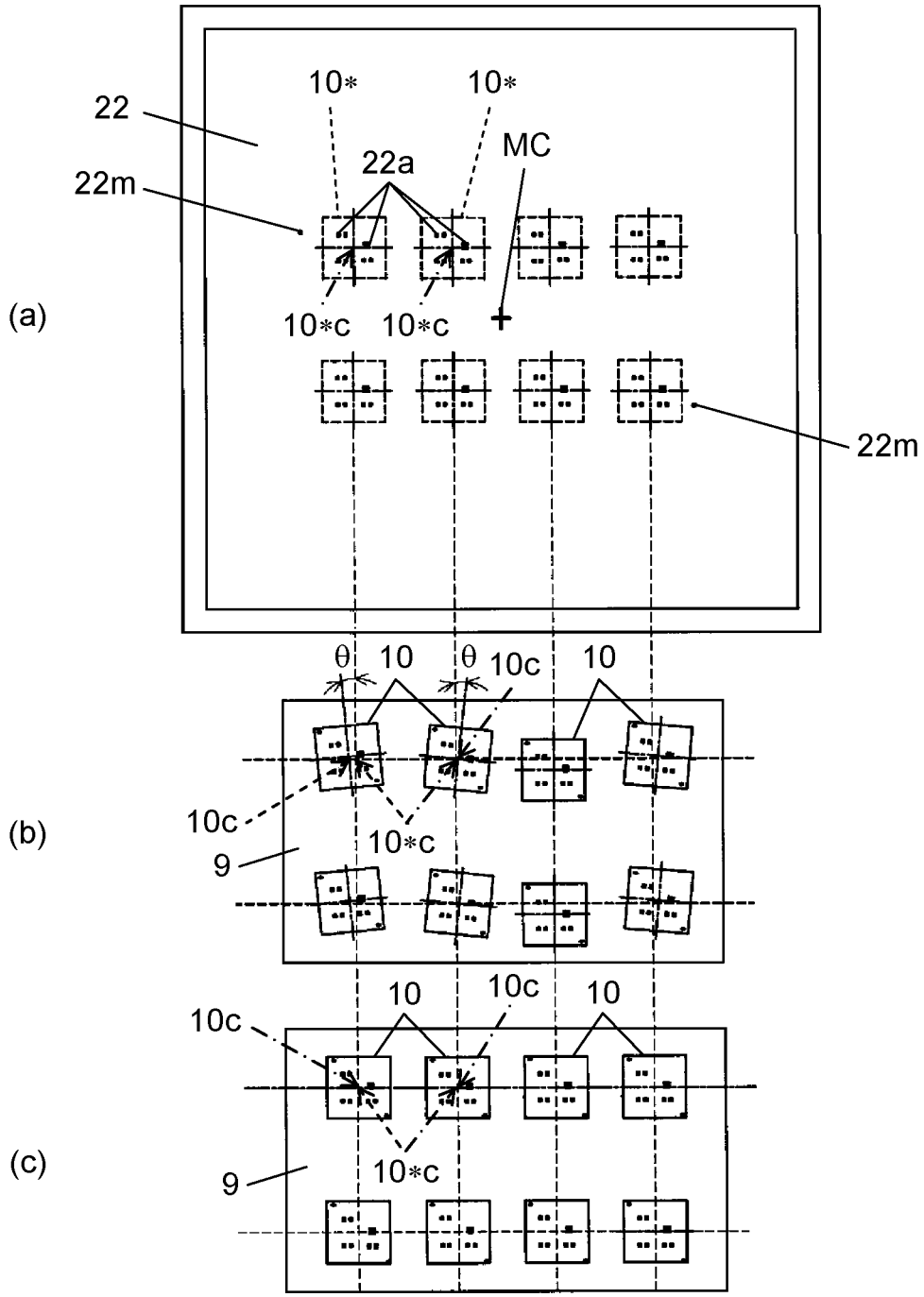
FIG. 15 is an operation explanatory view illustrating the screen printing method according to the embodiment of the disclosure.

Here, the above-described workpiece position correction amount will be described with reference to FIG. 15. FIG. 15(*a*) illustrates a plane of mask plate 22. Mask center MC indicating a center position of a mask surface and a pair of mask reference marks 22*m* that become a reference of the position on mask plate 22 are provided on mask plate 22. On mask plate 22, the plurality of sets of pattern holes 22*a* that correspond to the arrangement pattern of electrodes 10*a* in workpiece 10 which is a printing target are formed corresponding to the number of workpieces 10 on carrier 9.

Workpiece outer shape 10* indicated by the broken line frame in FIG. 15A illustrates the outer shape of workpiece 10 in a case where electrode 10*a* of workpiece 10 is precisely positioned with pattern hole 22*a*, and pattern center 10*c* illustrates the center of the workpiece outer shape 10*. The mask pattern data is obtained in advance in the preparation stage before starting the work and is stored in mask pattern position storage 35*a*.

Figure 13:
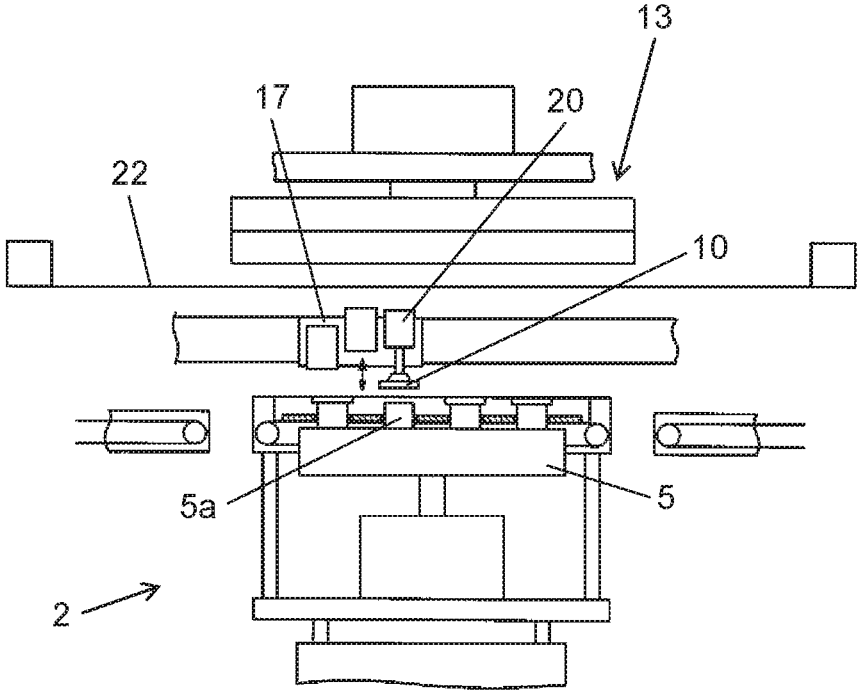
FIG. 13 is an operation explanatory view illustrating the screen printing method according to the embodiment of the disclosure.

FIG. 15(*b*) illustrates the result of executing the workpiece position detection in the aligning step. In other words, in the position detection of workpiece 10 by first camera 18 illustrated in FIG. 13, each of workpieces 10 is in an individually different positional deviation state in accordance with each of the disposition states on carriers 9. In the workpiece position detection, by recognizing the positions of the pair of recognition marks 10*m* in each of workpieces 10, together with the center positional deviation with respect to pattern center 10*c of workpiece center 10*c* indicating the center of each workpiece 10, rotation positional deviation θ indicating a deviation angle with respect to a mask reference direction in the workpiece reference direction indicating the direction of workpiece 10 within the plane, is detected.

Therefore, in order to cause the plurality of workpieces 10 disposed on carrier 9 to abut against the lower surface of mask plate 22 and to correctly perform the screen printing of paste P at once with respect to the workpieces 10, it is necessary to perform an aligning operation of compensating the center positional deviation and the rotation positional deviation of workpiece 10 in above-described carrier 9. In the workpiece position correction amount calculation in (ST10), the position correction amounts necessary for compensating the center positional deviation and the rotation positional deviation are individually obtained for each workpiece 10 by the arithmetic processing function of alignment processor 31.

FIG. 15(*c*) illustrates the arrangement state of workpiece 10 after the alignment processing by individually correcting the position of workpiece 10 by applying the workpiece position correction amount obtained in this manner. In other words, in the state, a state where the arrangement of workpieces 10 and pattern holes 22*a* match with each other, workpiece center 10*c* of workpiece 10 and pattern center 10*c on mask plate 22 match with each other, and the interval between workpieces 10 or a workpiece reference direction of workpiece 10 matches with a mask reference direction of mask plate 22, is achieved.

Next, when it is determined that (ST11) is completed and the alignment processing is completed with respect to all of workpieces 10, workpiece alignment state inspection for inspecting whether or not the arrangement state of workpieces 10 disposed in the aligned state on carrier 9 is correct is executed (ST12). In other words, after the aligning step is completed, by sequentially imaging all of workpieces 10 returned and placed to workpiece supporter 5*a* while moving first camera 18, the alignment state of workpiece 10 is inspected, that is, the positional deviation amount from the ideal position is detected.

In addition, by comparing the detected positional deviation amount with a determination threshold value stored in storage 35, it is determined whether or not the workpiece alignment state is a pass (ST13). Here, in a case where it is determined that the workpiece alignment state is a pass, the process proceeds to (ST16). Meanwhile, in a case where it is determined in (ST13) that the workpiece alignment state is a fail, the number of times of fails is confirmed. Here, in a case where it is determined that the number of fails is less than a predetermined number of times set in advance, the process returns to [1] and the processing after (ST9) is repeatedly executed. In addition, in a case where the number of fails has reached the predetermined number in (ST14), it is determined that some troubles have occurred and error notification is performed (ST15).

Figure 16:
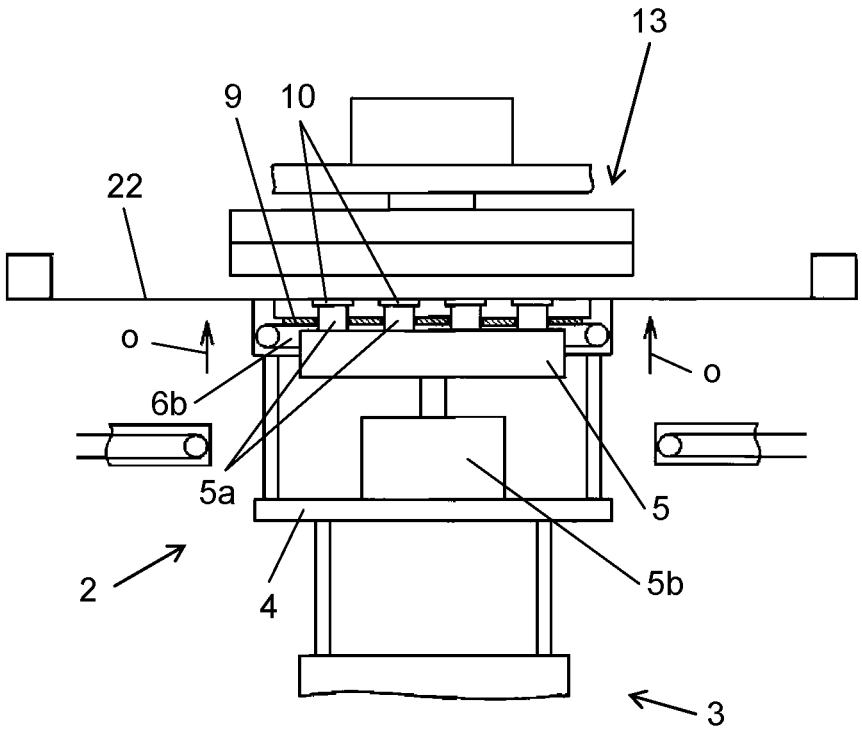
FIG. 16 is an operation explanatory view illustrating the screen printing method according to the embodiment of the disclosure.

In (ST16), the alignment is executed. In other words, in order to position the plurality of aligned workpieces 10 and mask plate 22 to each other, printing stage 2 provided with workpiece supporter 5*a* and mask plate 22 are relatively moved (alignment step). In other words, as illustrated in FIG. 16, the printing stage moving mechanism 3 is driven (arrow o) to position printing stage 2 which is in a state where workpiece 10 in the alignment state is placed on workpiece supporter 5*a* with respect to mask plate 22.

Here, the position of printing stage 2 in the horizontal direction is adjusted by printing stage XYΘ table 3*xy*θ. Accordingly, electrode 10*a* of workpiece 10 is positioned to pattern hole 22*a* of mask plate 22, printing stage 2 is raised by second raising and lowering mechanism 3*z* (arrow o), and workpiece 10 abuts against the lower surface of mask plate 22.

After this, the screen printing is executed. In other words, by moving print head 13 on the upper surface of mask plate 22, paste P is printed on the plurality of aligned workpieces 10 from the upper surface of mask plate 22 through pattern hole 22*a* (printing step). In the printing step, a paste filling step of filling pattern hole 22*a* with the paste and a plate separating of separating workpiece 10 from mask plate 22 are executed (print head moving (paste filling step): ST17).

Figure 17A:
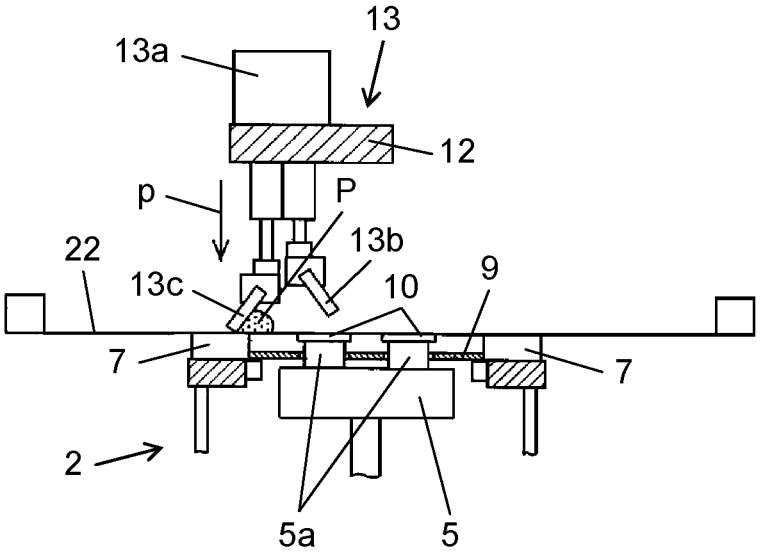
FIG. 17A is an operation explanatory view illustrating the screen printing method according to the embodiment of the disclosure.

In the print head moving, as illustrated in FIG. 17A, first, print head 13 is positioned at a predetermined squeegeeing start position and squeegee driver 13*a* is driven to lower (arrow p) either one of two rear squeegee 13*b* or front squeegee 13*c* (in the example described here, front squeegee 13*c*) with respect to the upper surface of mask plate 22 in a state where paste P is supplied, and brings the lower end portion of front squeegee 13*c* into sliding contact with mask plate 22. At this time, workpiece 10 which is a printing target abuts against the lower surface of mask plate 22 in a state of being received under workpiece supporter 5*a*.

Figure 17B:
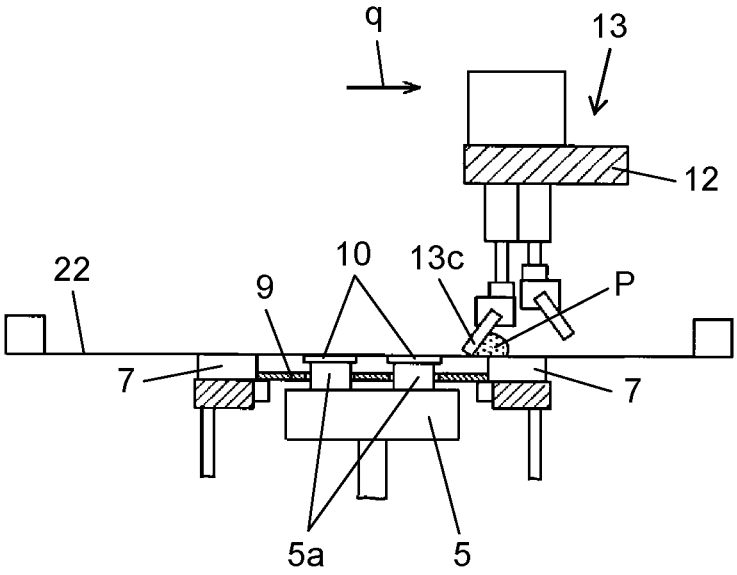
FIG. 17B is an operation explanatory view illustrating the screen printing method according to the embodiment of the disclosure.

Next, by driving print head moving mechanism 14 (refer to FIGS. 1 and 2), as illustrated in FIG. 17B, print head 13 is moved in the squeegeeing direction (arrow q) together with print head support beam 12. Accordingly, front squeegee 13*c* on the upper surface of mask plate 22 slides while filling pattern hole 22*a* formed on mask plate 22 with paste P, and paste P is printed on electrode 10*a* of workpiece 10.

Figure 18:
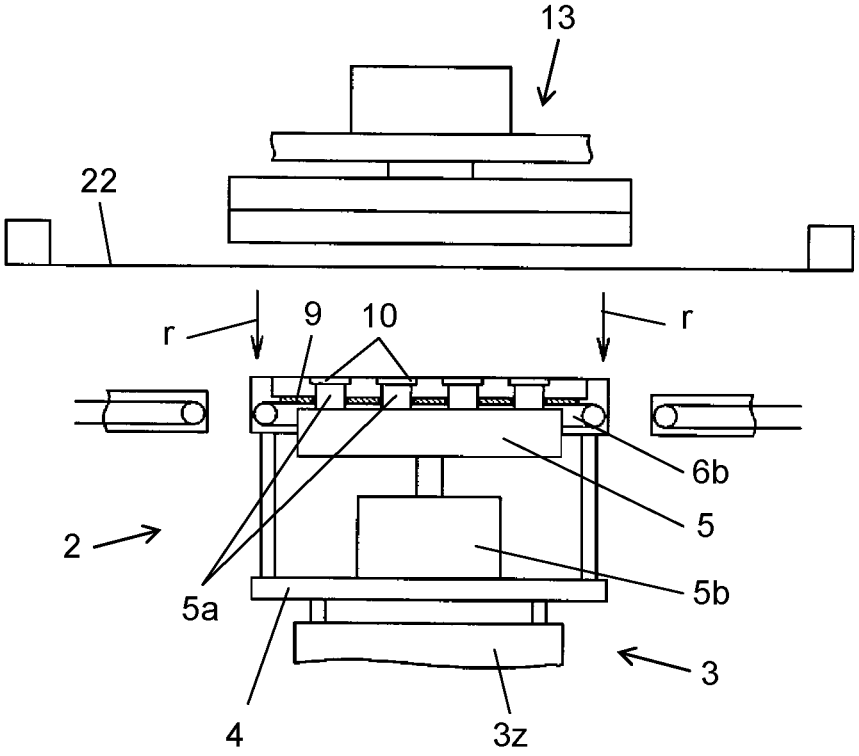
FIG. 18 is an operation explanatory view illustrating the screen printing method according to the embodiment of the disclosure.

After this, plate separation of lowering printing stage 2 is executed (ST18). In other words, as illustrated in FIG. 18, second raising and lowering mechanism 3*z* of printing stage moving mechanism 3 is driven to lower printing stage 2 (arrow r). Accordingly, the plate separation of separating the printing surface on the upper surface of workpiece 10 from the lower surface of mask plate 22 is performed. In addition, by releasing the vacuum suction from suction path 5*c* in workpiece supporter 5*a*, suction to workpiece supporter 5*a* of workpiece 10 is released (ST19).

Figure 19:
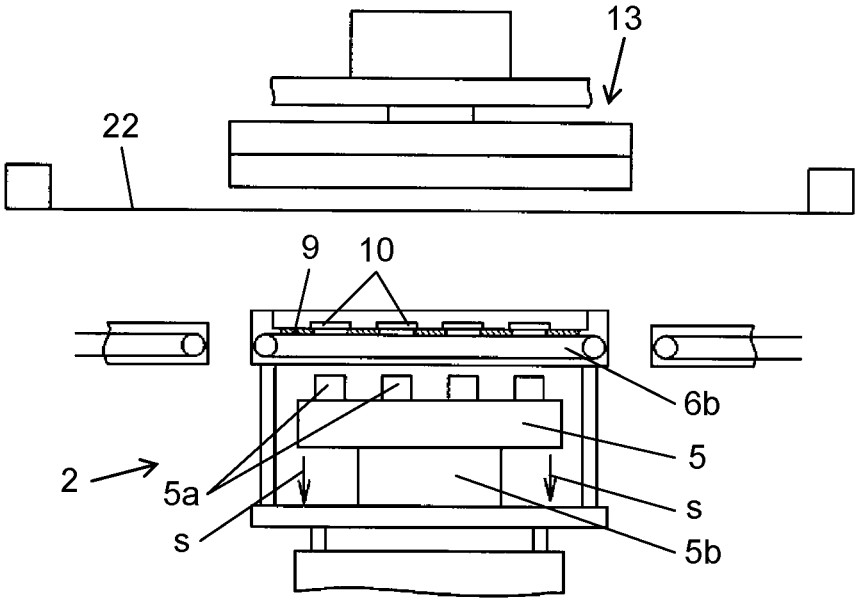
FIG. 19 is an operation explanatory view illustrating the screen printing method according to the embodiment of the disclosure.

Next, after the printing step, backup unit 5 is lowered (arrow s) and the received state of workpiece 10 is released (lowering of backup unit) (ST20). In other words, as illustrated in FIG. 19, a plurality of workpiece supporters 5*a* are drawn out downward from the plurality of first openings 9*c*, and accordingly, the plurality of workpieces 10 return to workpiece storage recess portion 9*b* of carrier 9 (returning step). At the same time, releasing the clamping of carrier 9 by side clamp 7 releases the carrier holding (ST21). Accordingly, carrier 9 is in a state of being held in printing stage conveyor 6*b*.

Figure 20:
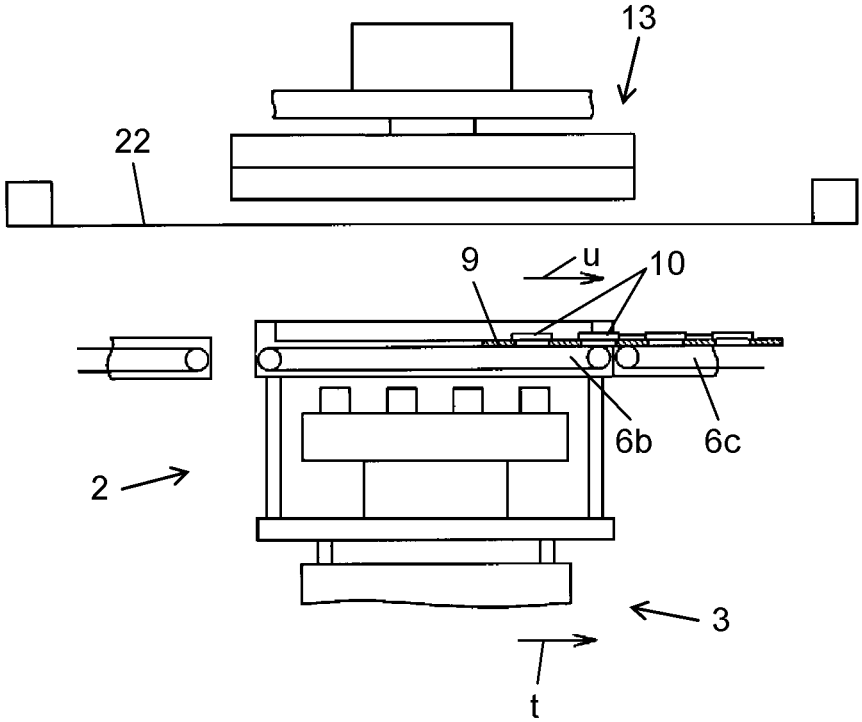
FIG. 20 is an operation explanatory view illustrating the screen printing method according to the embodiment of the disclosure.

In addition, after this, carrier carry-out is executed (ST22). In other words, as illustrated in FIG. 20, printing stage moving mechanism 3 is driven to move printing stage 2 to the downstream side (arrow t), and printing stage conveyor 6*b* is in a state of being connected to carry-out conveyor 6*c*. In addition, in this state, by driving printing stage conveyor 6*b* and carry-out conveyor 6*c*, carrier 9 on which the plurality of workpieces 10 after the printing are disposed is transferred from printing stage conveyor 6*b* to carry-out conveyor 6*c* (arrow u). Accordingly, the screen printing processing in which carrier 9 on which the plurality of workpieces 10 are disposed is considered as a target is completed.

In the above-described processing flow, (ST9) to (ST11) configure the above-described aligning step. The aligning step includes a workpiece position detecting step (ST9) of obtaining the positional deviation from the ideal position of each of workpieces 10 by detecting the positions of the plurality of workpieces 10 on the plurality of workpiece supporters 5*a*, a workpiece pickup step of picking up at least one workpiece 10 after completing the workpiece position detecting step, from workpiece supporters 5*a* by workpiece pickup unit 20, a position correcting step of relatively moving workpiece pickup unit 20 and workpiece supporters 5*a* based on the positional deviation of workpiece 10 detected in the workpiece position detecting step, and a placing step of placing workpiece 10 picked up by workpiece pickup unit 20 on workpiece supporter 5*a*, after the position correcting step.

Furthermore, in the aligning step, it is determined whether or not the positional deviation in the positional deviation detecting step is within an allowable range, and when the positional deviation is within the allowable range, the workpiece pickup step and the position correcting step for workpiece 10 are skipped. Accordingly, it is possible to prevent deterioration in productivity due to execution of unnecessary position correction work for workpiece 10 having a good positional deviation state.

Furthermore, after the aligning step, the positional deviation detecting step for the workpiece alignment state inspection is executed again, and in a case where it is determined that all of the positional deviations of workpieces 10 are within the allowable range and a pass is determined, the process proceeds to the aligning step, and in a case where it is determined that the positional deviation is a fail, the aligning step is performed with respect to workpiece 10 that exceeds the allowable range. Accordingly, it becomes possible to limit the execution of the alignment operation for the positional deviation compensation to failed workpiece of which the positional deviation exceeds the allowable range.

In addition, in the aligning step of executing the alignment in (ST16), the positional deviation detecting step for the workpiece alignment state inspection is performed after the aligning step, and based on the positions of the plurality of workpieces 10 obtained in the positional deviation detecting step, workpiece supporter 5*a* and mask plate 22 are relatively moved. Accordingly, it is possible to prevent printing from being executed while the alignment state is defective, and to ensure print quality.

As described above, in the screen printing described in the embodiment, the plurality of workpieces 10 lifted up by the plurality of workpiece supporters 5*a* are held below mask plate 22 on which the pattern holes 22*a* for printing are formed, the plurality of workpieces 10 on workpiece supporter 5*a* are aligned in accordance with the arrangement of pattern holes 22*a*, the alignment in which the workpiece supporter 5*a* and mask plate 22 are relatively moved for positioning the plurality of aligned workpieces 10 and mask plate 22 to each other is executed, and paste P is printed on the plurality of workpieces 10 aligned from the upper surface of mask plate 22 through pattern holes 22*a*.

Accordingly, in the screen printing with carrier 9 in which the plurality of workpieces 10 having different positional deviation states are disposed as the work target, the compensation of the positional deviation is performed for each individual workpiece 10, and the squeegeeing work that requires the longest work time in the printing work can be performed at once with the plurality of workpieces 10 as a target. Therefore, it is possible to ensure high productivity while ensuring printing accuracy by compensating the positional deviation of workpiece 10 placed on carrier 9.

Furthermore, in the embodiment, since workpiece 10 is lifted up from carrier 9 at the time of printing, there are following advantages compared to the technique of the related art in which the printing is performed while workpiece 10 is placed on the carrier. First, in a case where the printing is performed in a state where workpiece is placed on the carrier, depending on the thickness of the workpiece or the depth of the workpiece storage recess portion, there is a concern that a gap is generated between the screen mask and the workpiece and printing defects, such as blurring, are generated. On the other hand, in the embodiment, since workpiece 10 is completely lifted up from carrier 9, such a gap is not generated.

In addition, in the technique of the related art, since it is necessary to correctly hold the position of the carrier on which the workpiece is placed, it is necessary to recognize the position of the carrier together with the workpiece, and it takes an imaging time for the position recognition. On the other hand, in the embodiment, since carrier 9 is used only for transporting workpiece 10, it is not necessary to recognize the position of carrier 9. Therefore, it is possible to shorten the work time by omitting the imaging time for the position recognition of the carrier.

Furthermore, in the technique of the related art, when lifting up the workpiece from the carrier after performing the position recognition in a state where the workpiece is placed on the carrier, the positional deviation of the workpiece due to rubbing of the inner wall surface of the storage recess portion of the carrier and the workpiece is generated. On the other hand, in the embodiment, the position recognition is performed in a state where workpiece 10 is lifted up from carrier 9, and the position compensation is performed based on the position recognition result, the positional deviation due to lifting-up of workpiece 10 is not generated, and it is possible to obtain excellent printing position accuracy.

Although the embodiment is as described above, the disclosure can be implemented by changing the embodiment as exemplified below without departing from the spirit of the disclosure. For example, a dedicated moving mechanism for moving workpiece pickup unit 20 may be provided, and the moving mechanism dedicated to workpiece pickup unit 20 may be independently driven, or both of printing stage XYΘ table 3*xy*θ may function as the above-described alignment mechanism. Furthermore, in a case where a cleaning mechanism for cleaning the lower surface of mask plate 22 is provided, workpiece pickup unit 20 may be attached to the cleaning mechanism. In this case, the cleaning mechanism is responsible for the entirety or a part of the function as the above-mentioned alignment mechanism.

Figure 21A:
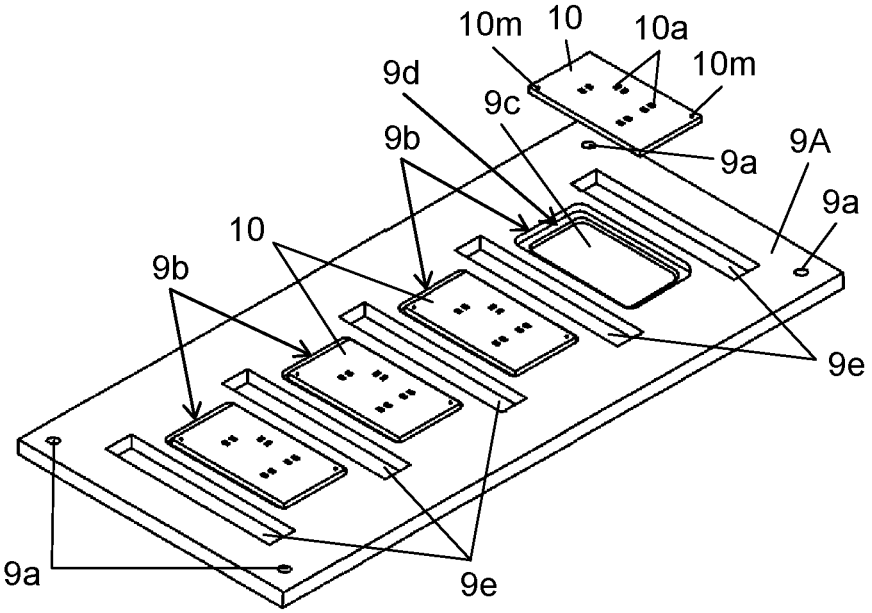
FIG. 21A is a perspective view of the carrier and a backup unit in a modification example of the screen printing apparatus according to the embodiment of the disclosure.

Next, with reference to FIGS. 21A, 21B, and 22A to 22C, a modification example in which a mask plate supporter that supports the lower surface of mask plate 22 is additionally provided in screen printing apparatus 1 according to the embodiment, will be described. FIG. 21A illustrates carrier 9A used in the modification example. Similar to carrier 9 illustrated in FIGS. 3 and 4, carrier 9A is used by disposing the plurality of workpieces 10 thereon and supporting a pair of opposing edge portions from below on printing stage conveyor 6*b* which is the carrier supporter. Workpiece 10 is similar to that illustrated in FIG. 4, and the plurality of electrodes 10*a* for connection and the pair of recognition marks 10*m* for position recognition are formed on the upper surface.

On the upper surface of carrier 9A, similar to carrier 9, the plurality of recognition marks 9*a* for position recognition and the plurality of workpiece storage recess portions 9*b* for disposing workpieces 10 are formed in a predetermined arrangement. Workpiece storage recess portion 9*b* has a configuration similar to that illustrated in FIG. 4, at the circumferential edge of the opening portion which is open on the upper surface of workpiece storage recess portion 9*b*, workpiece receiver 9*d* is provided against which the lower surface of workpiece 10 abuts in a state where workpiece 10 is stored. In workpiece receiver 9*d*, first opening 9*c* that vertically penetrates carrier 9 is provided. In each of workpiece storage recess portions 9*b*, one workpiece 10 is disposed in a state where workpiece 10 covers first opening 9*c*. In addition, on carrier 9A, the plurality of second openings 9*e* are disposed nipping each of workpiece storage recess portions 9*b* from both sides, and are formed while penetrating carrier 9A in an up-down direction.

Figure 21B:
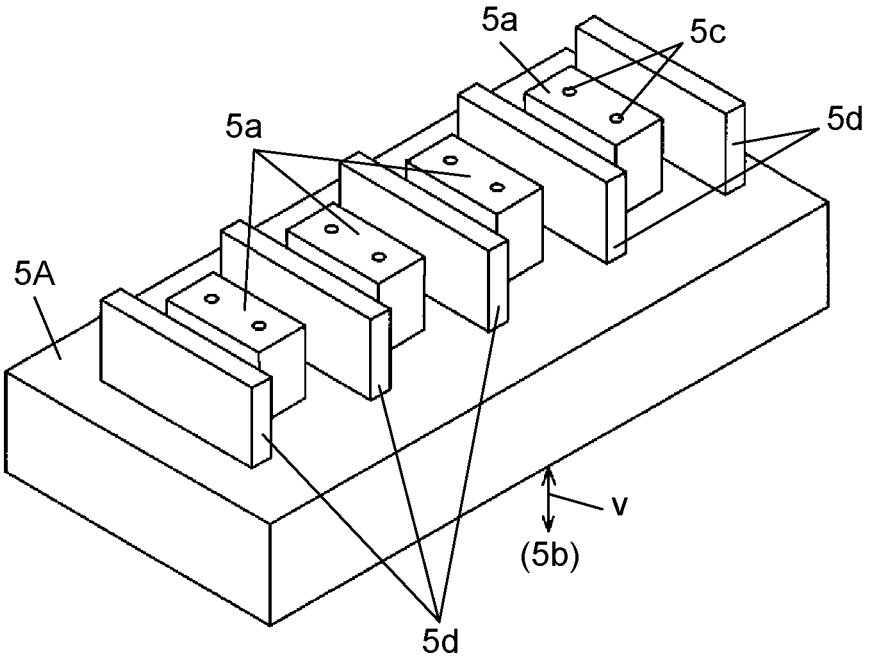
FIG. 21B is a perspective view of the carrier and the backup unit in a modification example of the screen printing apparatus according to the embodiment of the disclosure.

Carrier 9A having the above-described configuration is used in combination with backup unit 5A illustrated in FIG. 21B. In FIG. 21B, similar to backup unit 5 in FIGS. 1 and 2, backup unit 5A is raised and lowered (arrow v) by first raising and lowering mechanism 5*b*. On the upper surface of backup unit 5A, workpiece supporter 5*a* having the same configuration as that provided on the upper surface of backup unit 5 in FIG. 5 is provided corresponding to the arrangement of workpiece storage recess portions 9*b* on carrier 9A. Similar to FIG. 5, suction path 5*c* is provided in the workpiece supporter 5*a* such that workpiece 10 placed on the upper surface of workpiece supporter 5*a* can be suction held.

In addition, on both sides of one workpiece supporter 5*a* on the upper surface of backup unit 5A, corresponding to the disposition of second opening 9*e* on carrier 9A, mask plate supporter 5*d* is provided. Mask plate supporter 5*d* is disposed at a position that penetrates at least one second opening 9*e* which vertically penetrates carrier 9 and is formed in a shape and size vertically insertable into second opening 9*e*. Mask plate supporter 5*d* has a function of supporting a part of the lower surface of mask plate 22 in the screen printing operation.

Figure 22A:
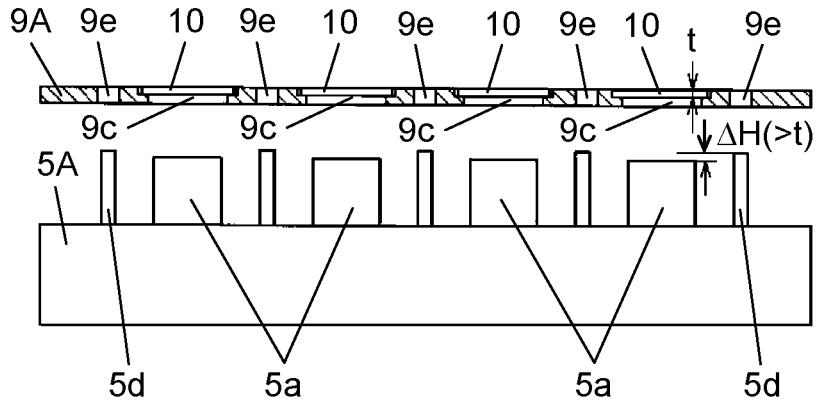
FIG. 22A is an operation explanatory view in a modification example of the screen printing method according to the embodiment of the disclosure.

Here, height difference ΔH is set such that the height of mask plate supporter 5*d* in backup unit 5A which is a raising and lowering base is higher than the height of the upper surface of the plurality of workpiece supporters 5*a* by an amount that corresponds to thickness t of workpiece 10 (refer to FIG. 22A). In other words, screen printing apparatus 1 illustrated in the embodiment is provided with at least one mask plate supporter 5*d* that supports at least a part of the lower surface of mask plate 22 when at least print head 13 performs the printing on workpiece 10.

FIG. 22A illustrates a state where carrier 9 on which workpiece 10 is placed on workpiece storage recess portion 9*b* is positioned above backup unit 5A so as to cover first opening 9*c*. In this state, workpiece 10 in a state of covering first opening 9*c* is positioned above each of workpiece supporters 5*a* on backup unit 5A. In addition, above mask plate supporter 5*d*, second opening 9*e* is positioned.

Figure 22B:
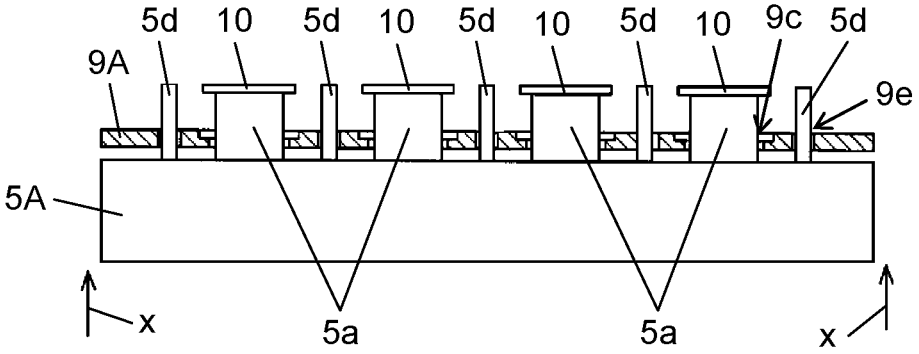
FIG. 22B is an operation explanatory view in a modification example of the screen printing method according to the embodiment of the disclosure.

FIG. 22B illustrates a state where backup unit 5A is raised (arrow x). In this state, workpiece 10 is lifted up by workpiece supporter 5*a* inserted through first opening 9*c*, and mask plate supporter 5*d* penetrates through second opening 9*e* and protrudes upward. In other words, mask plate supporter 5*d* and the plurality of workpiece supporters 5*a* are installed to backup unit 5A that serves as a raising and lowering base which is relatively raised and lowered relative to carrier supporter. In addition, when the plurality of workpiece supporters 5*a* lift up the plurality of workpieces 10 from carrier 9A, the upper surface of mask plate supporter 5*d* protrudes upward from the upper surface of carrier 9A.

Figure 22C:
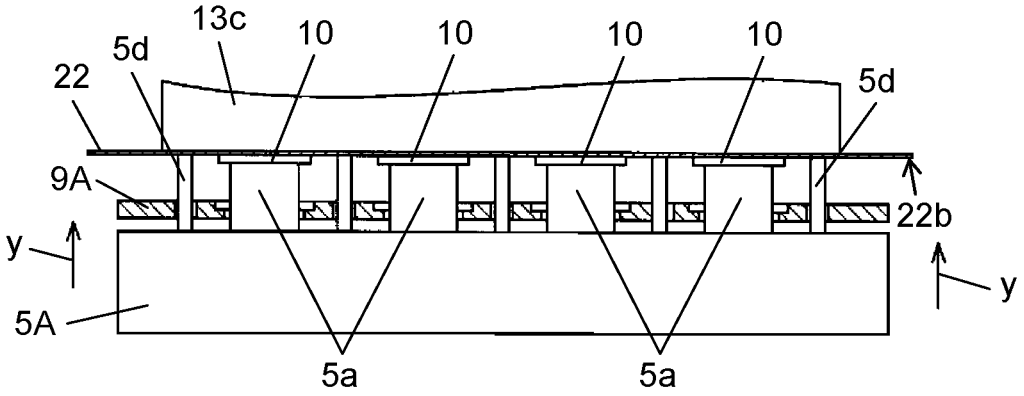
FIG. 22C is an operation explanatory view in a modification example of the screen printing method according to the embodiment of the disclosure.

FIG. 22C illustrates a support state of mask plate 22 when performing a printing operation at once by front squeegee 13*c* of print head 13 with the plurality of workpieces 10 lifted up (arrow y) by the plurality of workpiece supporters 5*a* as the target. In this state, workpiece 10 abuts against the lower surface of mask plate 22 and supports lower surface 22*b* of mask plate 22 by mask plate supporter 5*d* at least during the printing step.

Accordingly, deflection of mask plate 22 due to the application of the printing pressure of print head 13 to mask plate 22 in a state where the workpiece is not received is reduced. Therefore, it is possible to suppress printing failure caused by, for example, an edge of workpiece 10 making one-sided contact with mask plate 22, and it is possible to improve productivity while preventing printing failures in a multiple-sheet feeding method.

The screen printing apparatus and the screen printing method of the disclosure have an effect that it is possible to ensure high productivity while ensuring printing accuracy by compensating the positional deviation of the workpiece placed on the carrier, and are advantageous in a screen printing field in which the paste is printed on the workpiece, such as a board.

What is claimed is:

1. A screen printing apparatus comprising:

a mask plate on which a plurality of pattern holes for printing are formed;

a carrier supporter which supports a carrier through which a plurality of first openings vertically penetrate and in which a plurality of workpieces are disposed on the plurality of first openings;

a backup unit which has a plurality of workpiece supporters that support the plurality of workpieces from below and have a size insertable into the plurality of first openings, and which is configured to be raised and lowered to lift up and lower the plurality of workpieces relative to the carrier;

an aligner which aligns the plurality of workpieces lifted up by the plurality of workpiece supporters in accordance with arrangement of the plurality of pattern holes; and the aligner including a workpiece position detector that images the plurality of workpieces on the plurality of workpiece supporters, detects positions of the plurality of workpieces after being acted on by the aligner, and verifies said alignment relative to the plurality of pattern holes.

2. The screen printing apparatus of claim 1, wherein the aligner includes a workpiece position detector which includes a camera that images the plurality of workpieces on the plurality of workpiece supporters, detects positions of the plurality of workpieces by an image obtained by the camera, and detects a positional deviation from an ideal position of each of the plurality of workpieces, a workpiece pickup unit which picks up at least one of the plurality of workpieces on the plurality of workpiece supporters, and a workpiece alignment mechanism which relatively moves the workpiece pickup unit and the workpiece supporter in an XYθ direction based on the positional deviation detected by the workpiece position detector.

3. The screen printing apparatus of claim 2, further comprising:

a moving mechanism which moves the workpiece pickup unit in a space between the mask plate and the carrier supporter.

4. The screen printing apparatus of claim 3, wherein the moving mechanism includes a moving member that moves in a space between the mask plate and the carrier supporter, and wherein the camera and the workpiece pickup unit are installed on the moving member.

5. The screen printing apparatus of claim 2, wherein the overlapper includes an alignment mechanism that moves the backup unit in the XYθ direction, and wherein the alignment mechanism functions as the workpiece alignment mechanism.

6. The screen printing apparatus of claim 1, wherein the backup unit includes a workpiece suctioner that holds the plurality of workpieces under a negative pressure.

7. The screen printing apparatus of claim 6, wherein the workpiece suctioner is configured such that introduction and block of the negative pressure is selectable for each of the plurality of workpiece supporters, and wherein the aligner aligns the workpieces that correspond to the workpiece supporter in which the negative pressure is blocked among the plurality of workpiece supporters.

8. The screen printing apparatus of claim 1, further comprising:

a mask plate supporter which supports a part of a lower surface of the mask plate when the print head prints the paste on the plurality of workpieces.

9. The screen printing apparatus of claim 8, wherein the mask plate supporter and the plurality of workpiece supporters are installed on a raising and lowering base which rises and lowers relative to the carrier supporter, and wherein, when the raising and lowering unit lifts up the plurality of workpieces from the carrier, an upper surface of the mask plate supporter protrudes above an upper surface of the carrier.

10. The screen printing apparatus of claim 9, wherein a height of the mask plate supporter is higher than a height of an upper surface of the plurality of workpiece supporters by an amount that corresponds to a thickness of the plurality of workpieces.

11. The screen printing apparatus of claim 8, wherein the mask plate supporter is disposed at a position that corresponds to a second opening which vertically penetrates the carrier.

12. A screen printing method comprising:

arranging a plurality of workpieces on a plurality of first vertical openings of a carrier below a mask plate on which a plurality of pattern holes for printing are formed;

lifting up the plurality of workpieces from the carrier while supporting the plurality of workpieces by a plurality of workpiece supporters by inserting the plurality of workpiece supporters from below through the plurality of first openings;

aligning the plurality of workpieces such that arrangement of the plurality of workpieces lifted up by the plurality of workpiece supporters and arrangement of the plurality of pattern holes match each other;

after the aligning, imaging and detecting positions of the plurality of workpieces on the plurality of workpiece supporters, and verifying the alignment relative to the plurality of pattern holes;

and a returning step of returning the plurality of workpieces to the carrier by drawing out the plurality of workpiece supporters downward from the plurality of first openings after printing on the plurality of workpieces.

13. The screen printing method of claim 12, wherein the aligning step includes a workpiece position detecting step of detecting a positional deviation from an ideal position of each of the plurality of workpieces by detecting positions of the plurality of workpieces on the plurality of workpiece supporters, a workpiece pickup step of picking up at least one workpiece among the plurality of workpieces after completing the workpiece position detecting step, from the plurality of workpiece supporters by a workpiece pickup unit, a position correcting step of relatively moving the pickup unit and the plurality of workpiece supporters based on the positional deviation detected in the workpiece position detecting step, and a placing step of placing at least one workpiece picked up by the workpiece pickup unit on the plurality of workpiece supporters, after the position correcting step.

14. The screen printing method of claim 13, wherein it is further determined whether or not the positional deviation detected in the workpiece position detecting step is within an allowable range, and when the positional deviation is within the allowable range, the workpiece pickup step and the position correcting step for at least one workpiece are skipped.

15. The screen printing method of claim 12, wherein, at least during the printing step, a lower surface of the mask plate is supported by a mask plate supporter.

16. A screen printing method comprising:

a carrier carry-in step of disposing a carrier through which a plurality of first openings vertically penetrate and in which a plurality of workpieces are disposed on the plurality of first openings, below a mask plate on which a plurality of pattern holes for printing are formed;

a lifting-up step of lifting up the plurality of workpieces from the carrier while supporting the plurality of workpieces by the plurality of workpiece supporters by inserting the plurality of workpiece supporters from below the plurality of first openings;

an aligning step of aligning the plurality of workpieces such that arrangement of the plurality of workpieces lifted up by the plurality of workpiece supporters and arrangement of the plurality of pattern holes match each other;

an alignment step of relatively moving the plurality of workpiece supporters and the mask plate so as to position the plurality of aligned workpieces and the mask plate to each other;

a printing step of printing a paste on the plurality of aligned workpieces through the plurality of pattern holes by moving a print head on an upper surface of the mask plate; and a returning step of returning the plurality of workpieces to the carrier by drawing out the plurality of workpiece supporters downward from the plurality of first openings after the printing step, wherein the aligning step includes a workpiece position detecting step of detecting a positional deviation from an ideal position of each of the plurality of workpieces by detecting positions of the plurality of workpieces on the plurality of workpiece supporters, a workpiece pickup step of picking up at least one workpiece among the plurality of workpieces after completing the workpiece position detecting step, from the plurality of workpiece supporters by a workpiece pickup unit, a position correcting step of relatively moving the pickup unit and the plurality of workpiece supporters based on the positional deviation detected in the workpiece position detecting step, and a placing step of placing at least one workpiece picked up by the workpiece pickup unit on the plurality of workpiece supporters, after the position correcting step, wherein, further, after the aligning step, the workpiece position detecting step is executed again, and when all of the positional deviations of the plurality of workpieces are within the allowable range, a pass is determined, wherein, when the pass is determined, the process proceeds to the alignment step, and wherein, when the pass is not determined, the aligning step is performed with respect to the workpiece that exceeds the allowable range.

17. The screen printing method of claim 15, wherein, in the alignment step, based on the positions of the plurality of workpieces detected in the workpiece position detecting step performed after the aligning step, the plurality of workpiece supporters and the mask plate are relatively moved.

18. A screen printing apparatus comprising:

a mask plate on which a plurality of pattern holes for printing are formed;

a carrier supporter which supports a carrier through which a plurality of first openings vertically penetrate and in which a plurality of workpieces are disposed on the plurality of first openings;

a backup unit which has a plurality of workpiece supporters that support the plurality of workpieces from below and have a size insertable into the plurality of first openings, and which is configured to be raised and lowered to lift up and lower the plurality of workpieces relative to the carrier; and a workpiece position detector that, after an alignment of one or more of the plurality of workpieces on the plurality of workpiece supporters, images the plurality of workpieces on the plurality of workpiece supporters, detects positions of the plurality of workpieces, and verifies alignment relative to the plurality of pattern holes prior to printing occurring on the plurality of workpieces.

* * * * *